US007246608B2

(12) United States Patent
Kano et al.

(10) Patent No.: US 7,246,608 B2
(45) Date of Patent: Jul. 24, 2007

(54) FUEL VAPOR PROCESSING APPARATUS

(75) Inventors: Masao Kano, Gamagori (JP); Shinsuke Takakura, Kariya (JP); Noriyasu Amano, Gamogori (JP); Sinsuke Kiyomiya, Seto (JP); Yuusaku Nishimura, Toyota (JP)

(73) Assignees: Nippon Soken, Inc., Nishio, Aichi-pref. (JP); DENSO Corporation, Kariya, Aichi-pref. (JP); Toyota Jidosha Kabushiki Kaisha, Toyota, Aichi-pref. (JP)

( * ) Notice: Subject to any disclaimer, the term of this patent is extended or adjusted under 35 U.S.C. 154(b) by 22 days.

(21) Appl. No.: 11/295,729

(22) Filed: Dec. 7, 2005

(65) Prior Publication Data

US 2006/0144373 A1 Jul. 6, 2006

(30) Foreign Application Priority Data

Dec. 7, 2004 (JP) ..... 2004-354507

(51) Int. Cl.
*F02M 33/02* (2006.01)

(52) U.S. Cl. ..... 123/519; 123/520

(58) Field of Classification Search ..... 123/516, 123/518, 519, 520, 198 D
See application file for complete search history.

(56) References Cited

U.S. PATENT DOCUMENTS 6,695,895 B2 * 2/2004 Hyodo et al. ..... 96/111
6,786,207 B2 * 9/2004 Kojima et al. ..... 123/516
6,945,093 B2 * 9/2005 Amano et al. ..... 73/49.7
6,971,375 B2 * 12/2005 Amano et al. ..... 123/520

FOREIGN PATENT DOCUMENTS

JP 05-018326 1/1993
JP 06-101534 4/1994

* cited by examiner

*Primary Examiner*—Thomas Moulis
(74) *Attorney, Agent, or Firm*—Nixon & Vanderhye P.C.

(57) ABSTRACT

A fuel vapor processing apparatus includes a canister, a purge passage, a detection passage including an atmosphere passage and a restrictor, a passage changing valve for changing the connection passage of the detection passage between the purge passage and the atmosphere passage, a pump connecting with the detection passage on the opposite side of the passage changing valve across the restrictor, a pressure sensor for detecting a pressure between the restrictor and the pump, and an ECU for computing the concentration of fuel vapor. When the passage changing valve causes the purge passage to connect with the detection passage and the pump reduces pressure in the detection passage to pass the air-fuel mixture through the restrictor, the pressure sensor detects the pressure during a detection period of time that elapses after the air-fuel mixture passes through the restrictor until the air-fuel mixture reaches the pump.

25 Claims, 28 Drawing Sheets

FIG. 3

| | | | VALVE 23 | VALVE 19 | VALVE 21 | VALVE 20 | VALVE 18 | VALVE 22 |
|---|---|---|---|---|---|---|---|---|
| MAIN OPERATION | CONCENT-RATION MEASURE-MENT | S201 ($\Delta P_{Air}$) | OPEN | CLOSE | OPEN | I | CLOSE | I |
| | | S202 ($P_t$) | OPEN | CLOSE | CLOSE | I | CLOSE | I |
| | | S203 ($\Delta P_{Gas}$) | OPEN | CLOSE | OPEN | II | CLOSE | II |
| | PURGE | S302 (1st PURGE) | CLOSE | OPEN | OPEN | I | OPEN | I |
| | | S303 (2nd PURGE) | OPEN | CLOSE | OPEN | I | OPEN | I |
| CANISTER | | | OPEN | CLOSE | OPEN | I | CLOSE | I |

I : 1st STATE
II : 2nd STATE

FIG. 21

| | | | VALVE 23 | VALVE 19 | VALVE 21 | VALVE 310 | VALVE 312 | VALVE 18 | VALVE 22 |
|---|---|---|---|---|---|---|---|---|---|
| MAIN OPERATION | CONCENT-RATION MEASURE-MENT | S201 ($\Delta P_{Air}$) | OPEN | CLOSE | OPEN | OPEN | CLOSE | CLOSE | I |
| | | S202 ($P_t$) | OPEN | CLOSE | CLOSE | OPEN | CLOSE | CLOSE | I |
| | | S203 ($\Delta P_{Gas}$) | OPEN | CLOSE | OPEN | CLOSE | OPEN | CLOSE | II |
| | PURGE | S302 (1st PURGE) | CLOSE | OPEN | OPEN | OPEN | CLOSE | OPEN | I |
| | | S303 (2nd PURGE) | OPEN | CLOSE | OPEN | OPEN | CLOSE | OPEN | I |
| CANISTER | | | OPEN | CLOSE | OPEN | OPEN | CLOSE | CLOSE | I |

I : 1st STATE
II : 2nd STATE

FIG. 23

| | | | VALVE 23 | VALVE 19 | VALVE 310 | VALVE 312 | VALVE 18 | VALVE 22 |
|---|---|---|---|---|---|---|---|---|
| MAIN OPERATION | CONCENT-RATION MEASURE-MENT | S201 ($\Delta P_{Air}$) | OPEN | CLOSE | OPEN | CLOSE | CLOSE | I |
| | | S202 ($P_t$) | OPEN | CLOSE | CLOSE | CLOSE | CLOSE | I |
| | | S203 ($\Delta P_{Gas}$) | OPEN | CLOSE | CLOSE | OPEN | CLOSE | II |
| | PURGE | S302 (1st PURGE) | CLOSE | OPEN | OPEN | CLOSE | OPEN | I |
| | | S303 (2nd PURGE) | OPEN | CLOSE | OPEN | CLOSE | OPEN | I |
| CANISTER | | | OPEN | CLOSE | OPEN | CLOSE | CLOSE | I |

I : 1st STATE
II : 2nd STATE

FIG. 25

| | | | VALVE 23 | VALVE 19 | VALVE 21 | VALVE 20 | VALVE 18 | VALVE 22 |
|---|---|---|---|---|---|---|---|---|
| MAIN OPERATION | CONCENT-RATION MEASURE-MENT | S201 ($\Delta P_{Air}$) | OPEN | CLOSE | OPEN | I | CLOSE | I |
| | | S202 ($P_t$) | OPEN | CLOSE | CLOSE | I | CLOSE | I |
| | | S203 ($\Delta P_{Gas}$) | CLOSE | CLOSE | OPEN | II | CLOSE | II |
| | PURGE | S302 (1st PURGE) | CLOSE | OPEN | OPEN | I | OPEN | I |
| | | S303 (2nd PURGE) | OPEN | CLOSE | OPEN | I | OPEN | I |
| CANISTER | | | OPEN | CLOSE | OPEN | I | CLOSE | I |

I : 1st STATE
II : 2nd STATE

FIG. 27

| | | | VALVE 410 | VALVE 21 | VALVE 20 | VALVE 18 | VALVE 22 |
|---|---|---|---|---|---|---|---|
| MAIN OPERATION | CONCENT-RATION MEASURE-MENT | S201 ($\Delta P_{Air}$) | I | OPEN | I | CLOSE | I |
| | | S202 ($P_t$) | I | CLOSE | I | CLOSE | I |
| | | S203 ($\Delta P_{Gas}$) | I | OPEN | II | CLOSE | II |
| | PURGE | S302 (1st PURGE) | II | OPEN | I | OPEN | I |
| | | S303 (2nd PURGE) | I | OPEN | I | OPEN | I |
| CANISTER | | | I | OPEN | I | CLOSE | I |

I : 1st STATE
II : 2nd STATE

FIG. 29

| | | | VALVE 23 | VALVE 19 | VALVE 21 | VALVE 20 | VALVE 18 | VALVE 460 | VALVE 462 |
|---|---|---|---|---|---|---|---|---|---|
| MAIN OPERATION | CONCENT-RATION MEASURE-MENT | S201 ($\Delta P_{Air}$) | OPEN | CLOSE | OPEN | I | CLOSE | OPEN | CLOSE |
| | | S202 ($P_t$) | OPEN | CLOSE | CLOSE | I | CLOSE | OPEN | CLOSE |
| | | S203 ($\Delta P_{Gas}$) | OPEN | CLOSE | OPEN | II | CLOSE | CLOSE | OPEN |
| | PURGE | S302 (1st PURGE) | CLOSE | OPEN | OPEN | I | OPEN | OPEN | CLOSE |
| | | S303 (2nd PURGE) | OPEN | CLOSE | OPEN | I | OPEN | OPEN | CLOSE |
| CANISTER | | | OPEN | CLOSE | OPEN | I | CLOSE | OPEN | CLOSE |

I : 1st STATE
II : 2nd STATE

FUEL VAPOR PROCESSING APPARATUS

CROSS REFERENCE TO RELATED APPLICATIONS

This application is based on Japanese Patent Application No. 2004-354507 filed on Dec. 7, 2004, the disclosure of which is incorporated herein by reference.

FIELD OF THE INVENTION

The present invention relates to a fuel vapor processing apparatus.

BACKGROUND OF THE INVENTION

There has been conventionally known a fuel vapor processing apparatus that causes a canister temporarily to adsorb fuel vapor generated in a fuel tank and introduces the fuel vapor desorbed from the canister as required into an intake passage of an internal combustion engine to purge the fuel vapor. As one kind of fuel vapor processing apparatus like this, a fuel vapor processing apparatus that measures the concentration of fuel vapor in an air-fuel mixture introduced into an intake passage before the fuel vapor is purged and can hence purge a large quantity of fuel vapor in a short time is disclosed in patent documents 1, 2. In the fuel vapor processing apparatus disclosed in such patent documents 1, 2, the flow rate or the density of the air-fuel mixture in a passage for introducing fuel vapor into an intake passage is detected and the flow rate or the density of air in a passage open to the atmosphere is detected and the concentration of fuel vapor is computed from the ratio of these measurement results.

[Patent document 1] JP-5-18326A

[Patent document 2] JP-6-101534A

In fuel vapor processing apparatuses disclosed in the patent documents 1, 2, negative pressure in the intake passage is applied to respective passages to pass the air-fuel mixture or air through the respective passages and at the same time the flow rate or the density of the air-fuel mixture or air is detected. Therefore, when the negative pressure pulses, the flow rate or the density fluctuates and hence the concentration of fuel vapor computed on the basis of the detection results of such flow rate or density deteriorates in accuracy. Moreover, when the negative pressure in the intake passage is small, the flow rate of the air-fuel mixture or air in the respective passages decreases and hence cannot detect the flow rate or the density of the air-fuel mixture or air.

Therefore, the present inventors have earnestly conducted research on a fuel vapor processing apparatus that reduces pressure in a detection passage and passes air and an air-fuel mixture through the detection passage and at the same time monitors a change in pressure and computes the concentration of fuel vapor on the basis of the monitoring results. In such a fuel vapor processing apparatus, because pressure in the detection passage is reduced by a pump, a pressure to be detected is made stable except when detection conditions are changed and the flow rate of air or air-fuel mixture can be sufficiently secured in the detection passage. However, the results of research further conducted by the present inventors revealed that in a case where a pressure was detected while an air-fuel mixture was passing through the detection passage, when the air-fuel mixture taken into the detection passage by the pressure reducing action of a pump was sucked into the pump, the detection result of pressure fluctuated for some time. This problem is thought to be caused by the fact that the characteristics of the pump vary before and after the air-fuel mixture reaches the pump and hence can be solved when the pressure is detected after the characteristics of the pump stabilize. However, when the pressure is detected after the characteristics of the pump stabilize, the total time required to measure the concentration of fuel vapor increases and hence time for purging after the measurement of the concentration decreases. This presents a new problem that the quantity of actual purge (hereinafter referred to as "actual quantity of purge") decreases.

SUMAMRY OF THE INVENTION

The object of the present invention is to provide a fuel vapor processing apparatus capable of measuring the concentration of fuel vapor with accuracy in a short time.

When passage changing means connects a purge passage for guiding an air-fuel mixture to an intake passage with a detection passage and a pump reduces pressure in the detection passage to pass the air-fuel mixture through a restrictor provided at a middle portion of the detection passage, a period of time that elapses after the air-fuel mixture passes through the restrictor until the air-fuel mixture reaches the pump is assumed to be the period of detection. Because the characteristics of the pump are not varied by the suction of the air-fuel mixture during the period of detection, the pressure detected by the pressure detecting means becomes a stable value. Concentration computing means can compute the concentration of fuel vapor with accuracy on the basis of such a stable pressure value. In addition, when the air-fuel mixture passes through the restrictor, the pressure between the restrictor and the pump is detected before the air-fuel mixture reaches the pump. The time required to detect the pressure, that is, the total time required to measure the concentration of fuel vapor can be made short. As a result, it is possible to increase a purge time after the measurement of the concentration of fuel vapor and to sufficiently secure the actual quantity of purge.

BRIEF DESCRIPTION OF THE DRAWINGS

The above and other objects, features, and advantages of the present invention will become more apparent from the following detailed description made with reference to the accompanying drawings, in which like parts are designated by like reference number and in which:

FIG. 3 is a schematic diagram describing the main operation and the canister opening operation of the fuel vapor processing apparatus according to the first embodiment;

FIG. 21 is a schematic diagram describing the main operation and the canister opening operation of the fuel vapor processing apparatus according to the sixth embodiment;

FIG. 23 is a schematic diagram describing the main operation and the canister opening operation of the fuel vapor processing apparatus according to the modification of the sixth embodiment;

FIG. 25 is a schematic diagram describing the main operation and the canister opening operation of the fuel vapor processing apparatus according to the seventh embodiment;

FIG. 27 is a schematic diagram describing the main operation and the canister opening operation of the fuel vapor processing apparatus according to the eighth embodiment;

FIG. 29 is a schematic diagram describing the main operation and the canister opening operation of the fuel vapor processing apparatus according to the ninth embodiment;

DETAILED DESCRIPTION OF THE PREFERRED EMBODIMENTS

Hereinafter, multiple preferred embodiments of the present invention will be described on the basis of the drawings.

First Embodiment

Figure 1:
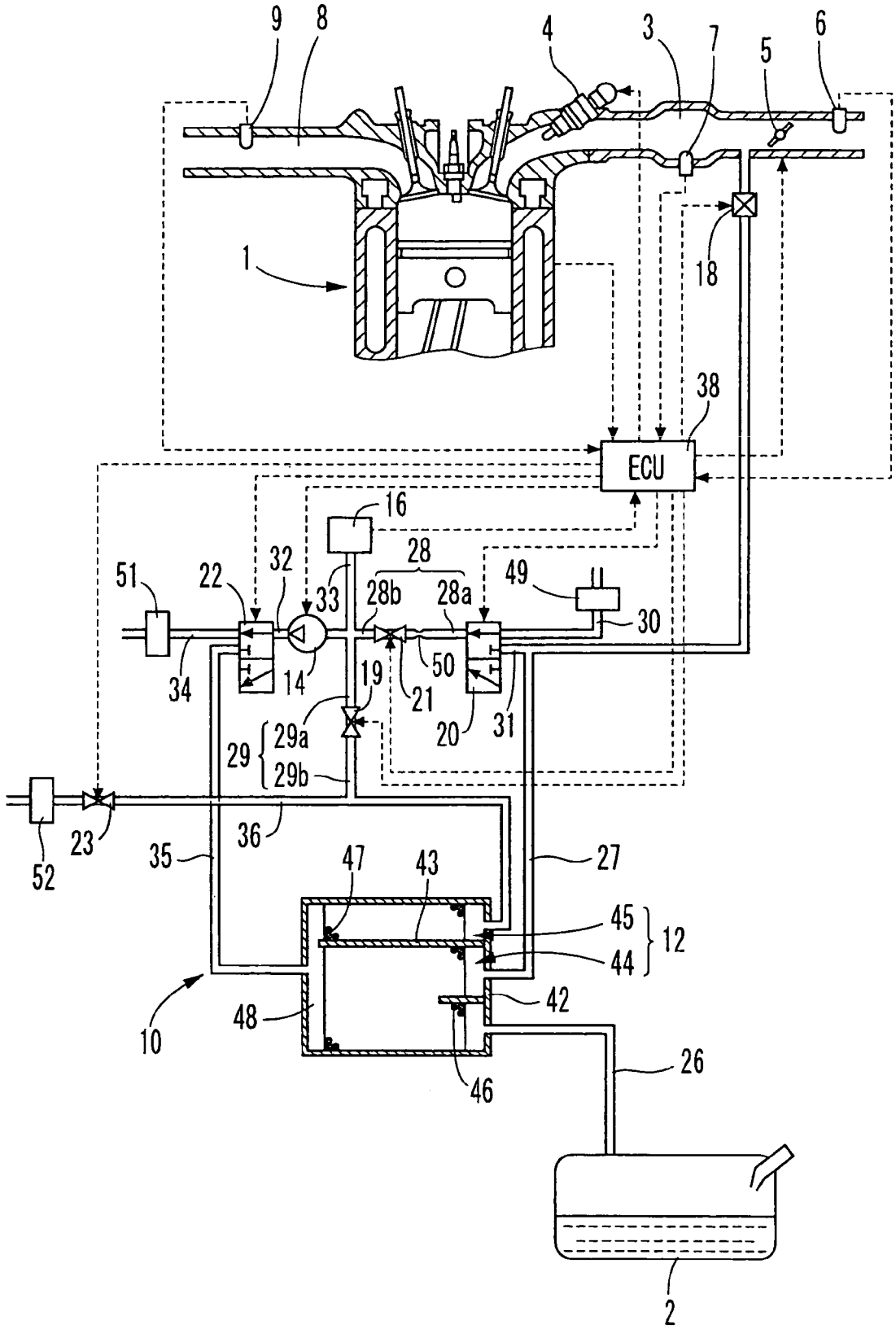
FIG. 1 is a construction diagram showing a fuel vapor processing apparatus according to a first embodiment.

FIG. 1 shows an example to which a fuel vapor processing apparatus 10 according to the first embodiment of the present invention is applied to the internal combustion engine 1 of a vehicle (hereinafter referred to as "engine").

First, the engine 1 will be described.

The engine 1 is a gasoline engine that develops power by the use of gasoline fuel received in a fuel tank 2. The intake passage 3 of the engine 1 is provided with, for example, a fuel injection device 4 for controlling the quantity of fuel injection, a throttle valve 5 for controlling the quantity of intake air, an air flow sensor 6 for detecting the quantity of intake air, an intake pressure sensor 7 for detecting an intake pressure, and the like. Moreover, the discharge passage 8 of the engine 1 is provided with, for example, an air-fuel ratio sensor 9 for detecting an air ratio.

Next, a fuel vapor processing apparatus will be described.

The fuel vapor processing apparatus 10 processes fuel vapor generated in the fuel tank 2 and supplies it to the engine 1. The fuel vapor processing apparatus 10 is provided with a canister 12, a pump 14, a differential pressure sensor 16, multiple valves 18 to 23, multiple passages 26 to 36, and an electronic control unit (ECU) 38.

The canister 12 has a case 42 partitioned by a partition wall 43 to form two adsorption parts 44, 45. The respective adsorption parts 44, 45 are packed with adsorptive agents 46, 47 made of activated carbon or the like. The main adsorption part 44 is provided with an introduction passage 26 connecting with the inside of the fuel tank 2. Hence, fuel vapor generated in the fuel tank 2 flows into the main adsorption part 44 through the introduction passage 26 and is adsorbed by the adsorptive agent 46 in the main adsorption part 44 in such a way as to be desorbed. The main adsorption part 44 is further provided with a purge passage 27 connecting with an intake passage 3. Here, a purge controlling valve 18 made of an electromagnetically driven type two-way valve is provided at the end of the intake passage side of the purge passage 27. The purge controlling valve 18 is opened or closed to control the connection of the purge passage 27 and the intake passage 3. With this, in a state where the purge controlling valve 18 is opened, a negative pressure developed on the downstream side of the throttle valve 5 of the intake passage 3 is applied to the main adsorption part 44 through the purge passage 27. Therefore, when the negative pressure is applied to the main adsorption part 44, fuel vapor is desorbed from the adsorptive agent 46 in the main adsorption part 44 and the desorbed fuel vapor is mixed with air and is introduced into the purge passage 27, whereby fuel vapor in the air-fuel mixture is purged to the intake passage 3. In this regard, the fuel vapor purged into the intake passage 3 through the purge passage is combusted in the engine 1 along with fuel injected from the fuel injection device 4.

The main adsorption part 44 connects with a subordinate adsorption part 45 via a space 48 at the inside bottom of the case 42. A transit passage 29 connecting with the middle portion of a detection passage 28 connects with the subordinate adsorption part 45. A connection controlling valve 19 made of an electromagnetically driven type two-way valve is provided in the middle portion of the transit passage 29. The connection controlling valve 19 is opened or closed to control the connection of a portion 29*a* closer to the detection passage 28 than the connection controlling valve 19 and a portion 29*b* closer to the subordinate adsorption part 45 than the connection controlling valve 19 of the transit passage 29. With this, in a state where the connection controlling valve 19 and the purge controlling valve 18 are opened, negative pressure in the intake passage 3 is applied to the subordinate adsorption part 45 through the purge passage 27, the main adsorption part 44, and the space 48 and also to the transit passage 29 and the detection passage 28. Therefore, when the negative pressure is applied to the subordinate adsorption part 45 in a state where an air-fuel mixture exists in the detection passage 28, the air-fuel mixture in the detection passage 28 flows into the subordinate adsorption part 45 through the transit passage 29, whereby fuel vapor in the air-fuel mixture is adsorbed by the adsorptive agent 47 in the subordinate adsorption part 45 in such a way as to be desorbed. Moreover, when the negative pressure is applied to the subordinate adsorption part 45, the fuel vapor is desorbed from the adsorptive agent 47 in the subordinate adsorption part 45 and the desorbed fuel vapor remains in the space 48 and then is adsorbed by the adsorptive agent 46 in the main adsorption part 44.

A passage changing valve 20 is constructed of an electromagnetically driven type three-way valve. The passage changing valve 20 is connected to a first atmosphere passage 30 open to the atmosphere via a filter 49. Moreover, the passage changing valve 20 is connected to a branch passage 31 branched from the purge passage 27 between the main adsorption part 44 and the purge controlling valve 18. Further, the passage changing valve 20 is connected to one end of the detection passage 28. The passage changing valve 20 connected in this manner changes a passage connecting with the detection passage 28 between the first atmosphere passage 30 and the branch passage 31 of the purge passage 27. Therefore, in a first state where the first atmosphere passage 30 connects with the detection passage 28, air can flow into the detection passage 28 through the first atmosphere passage 30. Moreover, in a second state where the branch passage 31 connects with the detection passage 28, an air-fuel mixture containing fuel vapor in the purge passage 27 can flow into the detection passage 28 through the branch passage 31.

The pump 14 is constructed of, for example, an electrically driven type vane pump. The suction port of the pump 14 connects with an end opposite to the passage changing valve 20 across a restrictor 50 of the detection passage 28 and the discharge port of the pump 14 connects with a first discharge passage 32. With this, when the pump 14 is operated, pressure in the detection passage 28 is reduced to discharge gas sucked from the detection passage 28 to the first discharge passage 32.

The restrictor 50 for restricting the passage area of the detection passage 28 is formed in the middle portion between the connection portion of the transit passage 29 and the passage changing valve 20 in the detection passage 28. Moreover, a passage opening/closing valve 21 made of an electromagnetically driven type two-way valve is provided in the middle portion between the connection portion of the transit passage 29 and the restrictor 50 in the detection passage 28. The passage opening/closing valve 21 is opened or closed to control the connection of a portion 28*a* closer to the passage changing valve 21 and a portion 28*b* closer to the pump 14 than the valve 21 of the detection passage 28. Here, when the portion 28*a* does not connect with the portion 28*b*, the detection passage 28 is brought into a closed state between the passage changing valve 20 connecting with the passages 30, 31 and the pump 14, whereas when the portions 28*a* connects with the portion 28*b*, the detection passage 28 is brought into an open state. That is, the passage opening/closing valve 21 opens or closes the detection passage 28 in a portion closer to the passages 30, 31 than the pump 14, to be more detailed, between the pump 14 and the restrictor 50.

The differential pressure sensor 16 connects with a pressure introducing passage 33 branched from the detection passage 28 between the passage opening/closing valve 21 and the pump 14. With this, the differential pressure sensor 16 detects a pressure difference between pressure receiving through the pressure introducing passage 33 from a portion closer to the pump 14 than the restrictor 50 of the detection passage 28 and the atmospheric pressure. Therefore, a pressure difference detected by the differential pressure sensor 16 when the pump 14 is operated is substantially equal to the pressure difference between both ends of the restrictor 50 in a state where the passage opening/closing valve 21 is opened. Moreover, in a state where the passage opening/closing valve 21 is closed, the detection passage 28 is closed on the suction side of the pump 14 and hence a pressure difference detected by the differential pressure sensor 16 when the pump 14 is operated is substantially equal to the shutoff pressure of the pump 14.

A discharge changing valve 22 is constructed of an electromagnetically driven three-way valve. The discharge changing valve 22 is connected to a second atmosphere passage 34 open to the atmosphere via a filter 51. Moreover, the discharge changing valve 22 is connected to a second discharge passage 35 connecting with the space 48 in the canister 12. Furthermore, the discharge changing valve 22 is connected to a first discharge passage 32 on the discharge side of the pump 14. The discharge changing valve 22 connected in this manner selects a passage connecting with the first discharge passage 32 between the second atmosphere passage 34 and the second discharge passage 35. Therefore, in the first state where the second atmosphere passage 34 connects with the first discharge passage 32, gas discharged from the pump 14 is dissipated to the atmosphere through the first discharge passage 32 and the second atmosphere passage 34. Moreover, in the second state where the second discharge passage 35 connects with the first discharge passage 32, gas discharged from the pump 14 can flow into the space 48 through the first discharge passage 32 and the second discharge passage 35.

A canister closing valve 23 is constructed of an electromagnetically driven type two-way valve and is provided in the middle portion in a third atmosphere passage 36 branched from the transit passage 29 between the connection controlling valve 19 and the subordinate adsorption part 45. An end opposite to the transit passage 29 across the canister closing valve 23 of the third atmosphere passage 36 is open to the atmosphere via a filter 52. Therefore, in a state where the canister closing valve 23 is opened, the subordinate adsorption part 45 is open to the atmosphere through the third atmosphere passage 36 and the transit passage 29.

The ECU 38 is mainly constructed of a microcomputer having a CPU and a memory and is electrically connected to the pump 14, the differential pressure sensor 16, and the valves 18 to 23 of the fuel vapor processing apparatus 10 and the respective elements 4 to 7 and 9 of the engine 1. The ECU 38 controls the respective operations of the pump 14 and the valves 18 to 23 on the basis of the detection results of the respective sensors 16, 6, 7, 9, the temperature of cooling water of the engine 1, the temperature of working oil of a vehicle, the number of revolutions of the engine 1, the accelerator position of the vehicle, the ON/OFF state of an ignition switch, and the like. Moreover, the ECU 38 of this embodiment has also the functions of controlling the engine 1, such as the quantity of fuel injection of the fuel injection device 4, the opening of the throttle valve 5, the ignition timing of the engine 1, and the like.

Figure 2:
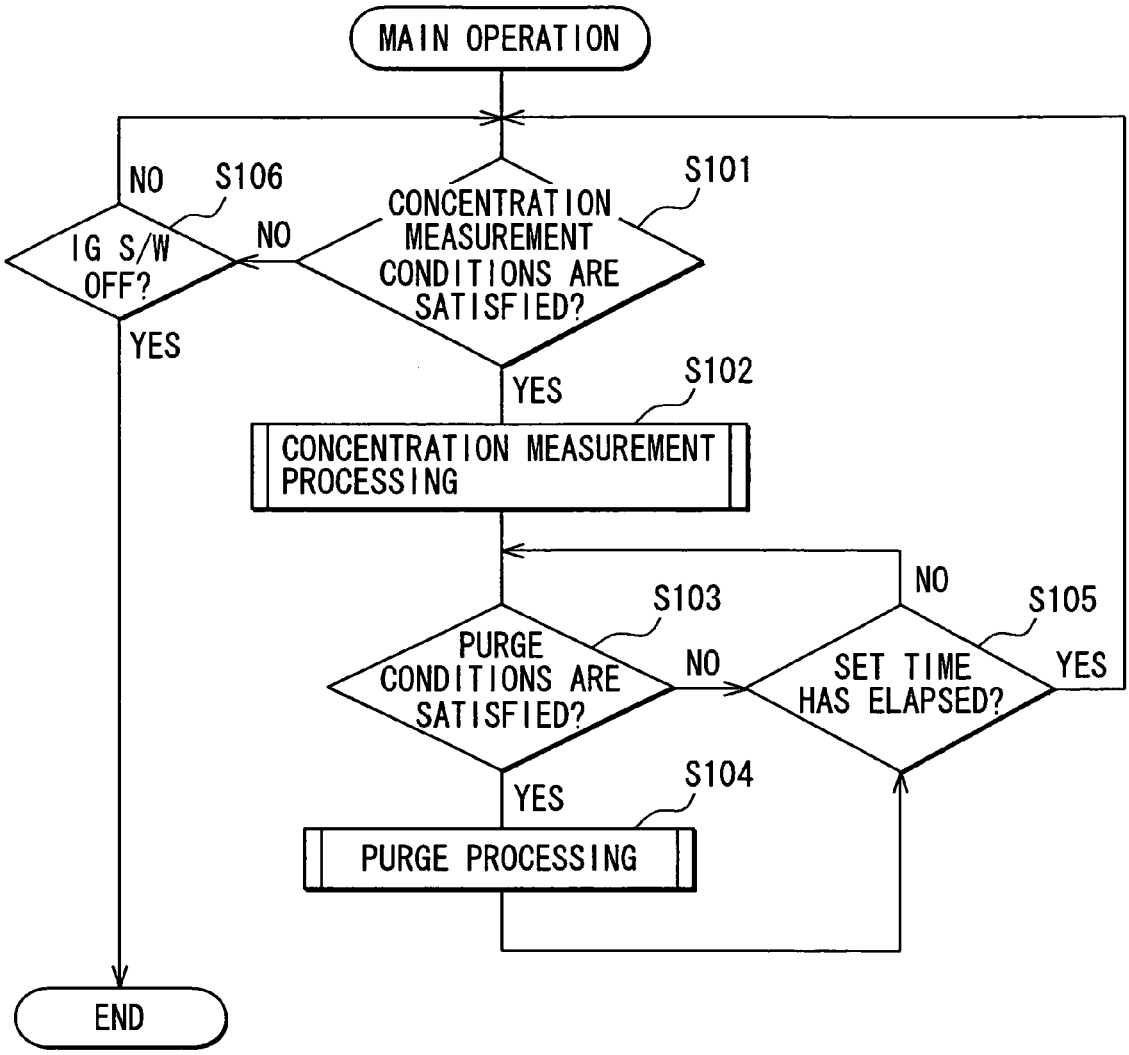
FIG. 2 is a flow chart describing the main operation of the fuel vapor processing apparatus according to the first embodiment.

Next, the flow of a main operation characteristic of the fuel vapor processing apparatus 10 will be described on the basis of FIG. 2. The main operation is started when an ignition switch is turned on to start the engine 1.

First, in step S101, it is determined by the ECU 38 whether or not concentration measurement conditions are satisfied. Here, the satisfaction of the concentration measurement conditions means that the physical quantities expressing the state of a vehicle, for example, the temperature of cooling water of the engine 1, the temperature of working oil of a vehicle, the number of revolutions of the engine is within specified ranges. Such concentration measurement conditions are previously set such that they are satisfied just after the engine 1 is started and are stored in the memory of the ECU 38.

When it is determined that step S101 is affirmative, the routine proceeds to step S102 where concentration measurement processing is carried out. When the concentration of fuel vapor in the purge passage 27 is measured by this concentration measurement processing in a state where the purge controlling valve 18 is closed, the routine proceeds to step S103 where it is determined by the ECU 38 whether or not purge conditions are satisfied. Here, the satisfaction of the purge conditions means that the physical quantities expressing the state of a vehicle, for example, the temperature of cooling water of the engine 1, the temperature of working oil of the vehicle, the number of revolutions of the engine are within specified ranges different from those of the above-mentioned concentration measurement conditions. Such purge conditions are previously set such that they are satisfied, for example, when the temperature of cooling water of the engine 1 becomes higher than a specified value and hence the warm-up of the engine 1 is completed and are stored in the memory of the ECU 38.

When it is determined that step S103 is affirmative, the routine proceeds to step S104 where purge processing is carried out. When fuel vapor is purged from the purge passage 27 into the intake passage 3 in a state where the purge controlling valve 18 is opened and purge stop conditions are satisfied, the routine proceeds to step S105. Here, the satisfaction of the purge stop conditions means that the physical quantities expressing the state of the vehicle, for example, the number of revolutions of the engine 1 and acceleration position are within specified ranges different from those of the above-mentioned concentration measurement conditions and the above-mentioned purge conditions. Such purge stop conditions are previously set such that they are satisfied, for example, when the acceleration position is made smaller than a specified value to decrease the speed of the vehicle, and are stored in the memory of the ECU 38.

Moreover, when it is determined that step S103 is negative, the routine proceeds directly to step S105.

In step S105, it is determined by the ECU 38 whether or not a set time elapses from the time when the concentration measurement processing in step S102 is finished. When it is determined that this step S105 is affirmative, the routine returns to step S101, whereas when it is determined that this step S105 is negative, the routine returns to step S103. Here, the above-mentioned set time to be the determination criterion in step S105 is previously set in consideration of secular changes in the concentration of fuel vapor and the required accuracy of the concentration and is stored in the memory of the ECU 38.

While following processing steps S102 to S105 when it is determined that step S101 is affirmative has been described, following processing step S106 when it is determined that step S101 is negative will be described.

Figure 4:
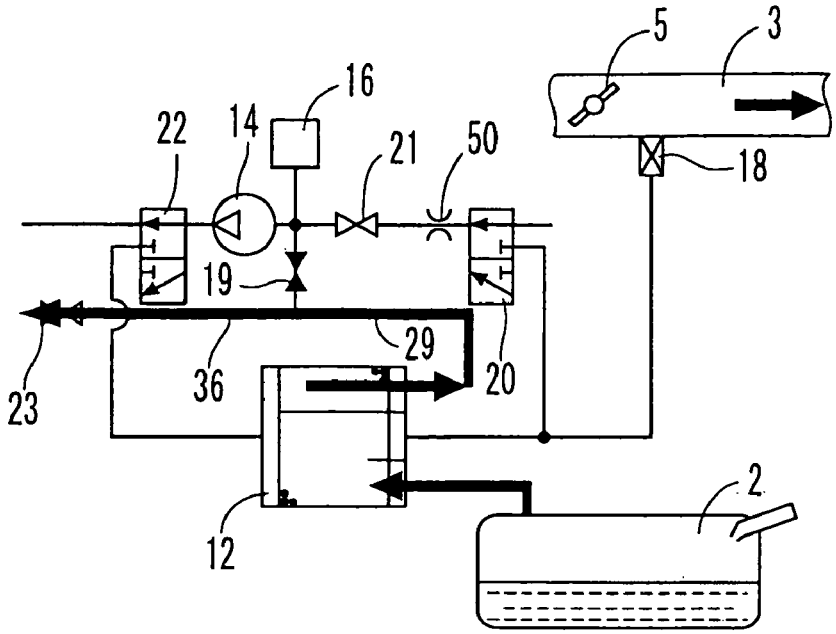
FIG. 4 is a schematic diagram describing the canister opening operation of the fuel vapor processing apparatus according to the first embodiment.

In step S106, it is determined by the ECU 38 whether or not the ignition switch is turned off. When it is determined that this step S106 is negative, the routine returns to step S101. Meanwhile, when it is determined that this step S106 is affirmative, the main operation is finished. In the fuel vapor processing apparatus 10, after the main operation is finished, the respective valves 18 to 23 are brought to the states shown in FIG. 3 to carry out a canister opening operation for opening the canister 12 to the atmosphere as shown in FIG. 4.

Here, the above-mentioned concentration measurement processing in step S102 will be described in more detail.

Figure 5:
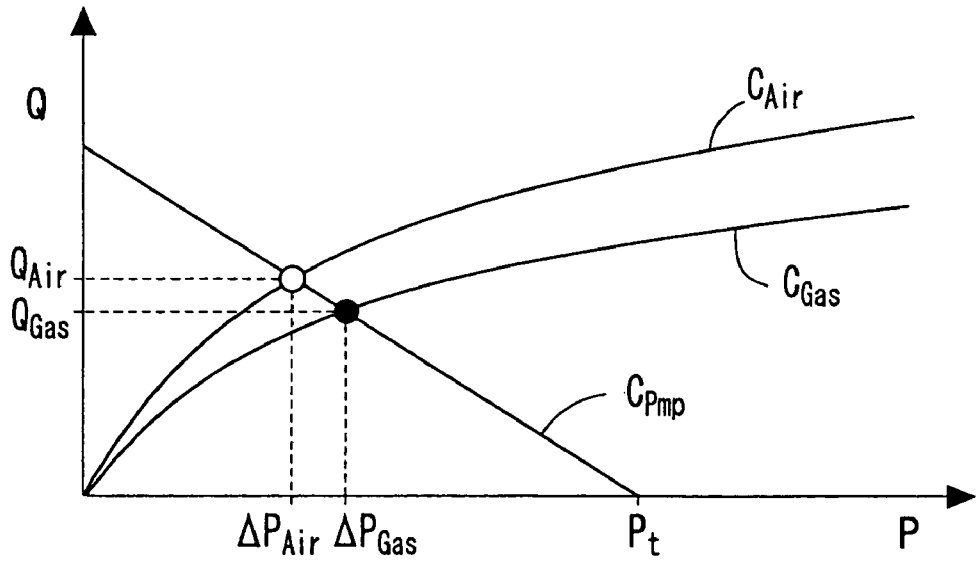
FIG. 5 is a characteristic graph describing concentration measurement processing in FIG. 2.

First, the measurement principle of the concentration of fuel vapor in the fuel vapor processing apparatus 10 will be described. For example, in a case where in the pump 14 is a vane pump, the quantity of internal leak varies according to load and hence, as shown in FIG. 5, the pressure (P)–flow rate (Q) characteristic curve $C_{pump}$ of the pump 14 is expressed by the following first-degree equation (1). Here, in the equation (1), K1 and K2 are constants specific to the pump 14.

$$Q=K1\times P+K2 \tag{1}$$

Here, assuming that the shutoff pressure of the pump 14 is $P_t$, Q=0 when the suction side of the pump 14 is shut off and hence the following equation (2) is obtained.

$$K2=-K1\times P_t \tag{2}$$

In the fuel vapor processing apparatus 10, the pressure loss of flowing gas is reduced to as small an quantity as can be neglected on a side closer to the pump 14 than the restrictor 50 of the detection passage 28. With this, in a state where the passage opening/closing valve 21 is opened, the pressure P of the pump 14 is thought to be substantially equal to the pressure difference ΔP between both ends of the restrictor 50 (hereinafter simply referred to as "pressure difference"). Therefore, the flow rate $Q_{Air}$ and the pressure difference $\Delta P_{Air}$ when air passes through the restrictor 50 satisfy the following relationship equation (3) obtained from the equations (1), (2).

$$Q_{Air}=K1\times(\Delta P_{Air}-P_t) \tag{3}$$

Moreover, the flow rate $Q_{Gas}$ and the pressure difference $\Delta P_{Gas}$ when an air-fuel mixture containing fuel vapor (hereinafter simply referred to as "air-fuel mixture") passes through the restrictor 50 also similarly satisfy the following equation (4) obtained from the equations (1), (2)

$$Q_{Gas}=K1\times(\Delta P_{Gas}-P_t) \quad (4)$$

The pressure difference (ΔP)–flow rate (Q) characteristic curve of gas at the restrictor 50 is expressed by the following equation (5) by the use of the density ρ of the gas passing through the restrictor 50. Here, K3 in the equation (5) is a constant specific to the restrictor 50 and is a value expressed by the following equation (6) when the diameter and the flow coefficient of the restrictor 50 are assumed to be d and α, respectively.

$$Q=K3\times(\Delta P/\rho)^{1/2} \quad (5)$$

$$K3=\alpha\times\pi\times d^2/4\times 2^{1/2} \quad (6)$$

Therefore, the ΔP–Q characteristic curve $C_{Air}$ shown in FIG. 5 is expressed by the following equation (7) by the use of the density $\rho_{air}$ of air.

$$Q_{air}=K3\times(\Delta P_{air}/\rho_{air})^{1/2} \quad (7)$$

Moreover, the ΔP–Q characteristic curve $C_{gas}$ shown in FIG. 5 is expressed by the following equation (7) by the use of the density $\rho_{gas}$ of the air-fuel mixture. Here, when it is assumed that the density of hydrocarbon (HC) of a component of fuel vapor is $\rho_{HC}$, the density $\rho_{gas}$ of the air-fuel mixture is related to the concentration "D" (%) of fuel vapor in the air-fuel mixture as shown by the following relationship equation (9).

$$Q_{Gas}=K3\times(\Delta P_{Gas}/\rho_{gas})^{1/2} \quad (8)$$

$$D=100\times\rho_{air}\times(1-\rho_{gas}/\rho_{air})/(\rho_{air}-\rho_{HC}) \quad (9)$$

Because equation (3)=equation (7) and equation (4)=equation (8) in the above equations, the following equations (10) and (11) are obtained.

$$\rho_{air}=K3^2\times\Delta P_{Air}/\{K1^2\times(\Delta P_{Air}-P_t)^2\} \quad (10)$$

$$\rho_{gas}=K3^2\times\Delta P_{Gas}/\{K1^2\times(\Delta P_{Gas}-P_t)^2\} \quad (11)$$

Therefore, when K1 and K3 are eliminated from the equations (10) and (11), the following equation (12) is obtained and the equation (13) of computing the concentration of fuel vapor is obtained from these equations (12) and (9) in the following manner.

$$\rho_{gas}/\rho_{air}=\Delta P_{Gas}/\Delta P_{Air}\times(\Delta P_{Air}-P_t)^2/(\Delta P_{Gas}-P_t)^2 \quad (12)$$

$$D=100\times\rho_{air}\times\{1-\Delta P_{Gas}/\Delta P_{Air}\times(\Delta P_{Air}-P_t)^2/(\Delta P_{Gas}-P_t)_2\}/(\rho_{air}-\rho_{HC}) \quad (13)$$

Figure 6:
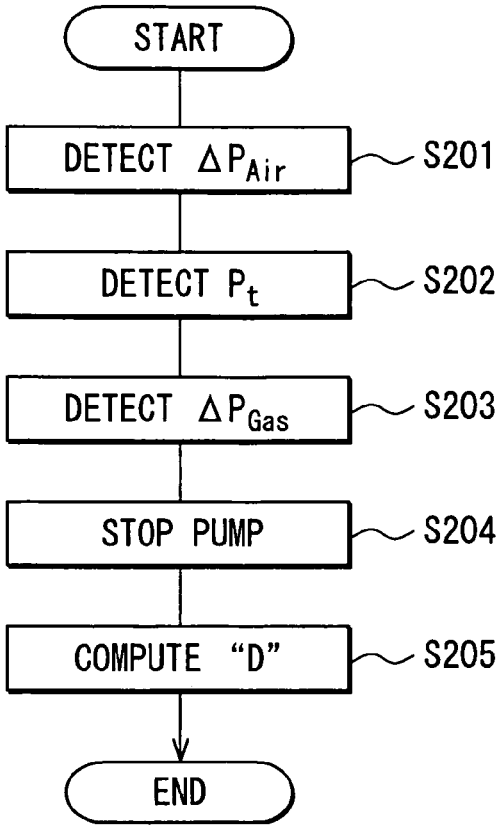
FIG. 6 is a flow chart describing the concentration measurement processing in FIG. 2.

In the equation (13) of computing the concentration "D" of fuel vapor obtained in this manner, $\rho_{air}$ and $\rho_{HC}$ are values determined as physical constants and are stored as a part of the equation (13) in the memory of the ECU 38 in this embodiment. Therefore, to compute the concentration "D" of fuel vapor by the use of the equation (13), the pressure differences $\Delta P_{Air}$, $\Delta P_{Gas}$ when air and air-fuel mixture pass through the restrictor 50 and the shutoff pressure $P_t$ of the pump 14 are necessary. Hence, in the above-mentioned concentration measurement processing in the step S102, the pressure differences $\Delta P_{Air}$, $\Delta P_{Gas}$ and the shutoff pressure $P_t$ are detected and the concentration "D" of fuel vapor is computed from these values. Hereinafter, the flow of the concentration "D" of fuel vapor will be described on the basis of FIG. 6. In this regard, it is assumed that the following states are established just before the concentration measurement processing is carried out: the pump 14 is in the state of stop; the purge controlling valve 18 and the connection controlling valve 19 are in a closed state; passage changing valve 20 and the discharge changing valve 22 is in the first state; and the passage opening/closing valve 21 and the canister closing valve 23 are in an open state.

Figure 7:
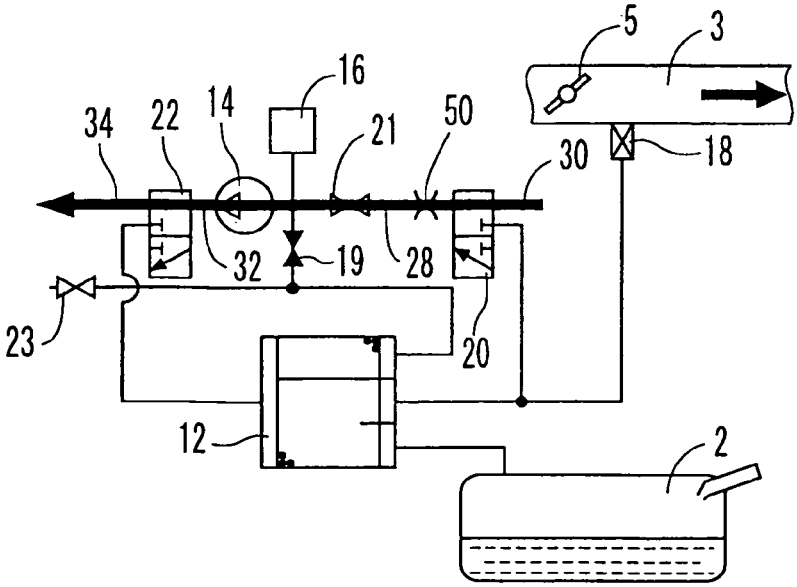
FIG. 7 is a schematic diagram describing the concentration measurement processing in FIG. 2.
Figure 8:
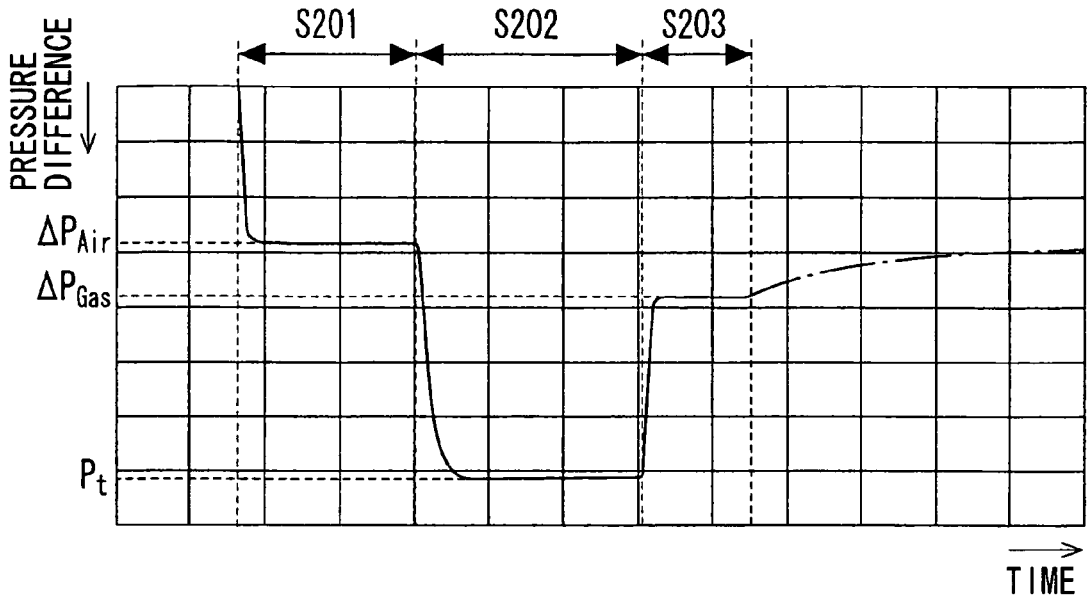
FIG. 8 is a characteristic graph describing the concentration measurement processing in FIG. 2.

First, in step S201, the pump 14 is driven to a specified number of revolutions by the ECU 38 to reduce pressure in the detection passage 28 to pressure smaller than negative pressure in the intake passage 3. At this time, the respective valves 18 to 23 are in the same states as the states just before the concentration measurement processing, as shown in FIG. 3, and hence as shown in FIG. 7, air flows from the first atmosphere passage 30 into the detection passage 28 and hence the pressure difference detected by the differential pressure sensor 16 is reduced to a specified value $\Delta P_{Air}$ as shown in FIG. 8. Then, in step S201, when the pressure difference detected by the differential pressure sensor 16 becomes stable, the stable value is stored as the pressure difference $\Delta P_{Air}$ when air passes through the restrictor 50 in the memory of the ECU 38. Here, in step S201, air discharged from the pump 14 to the first discharge passage 32 is dissipated into the atmosphere through the filter 51 of the second atmosphere passage 34.

Figure 9:
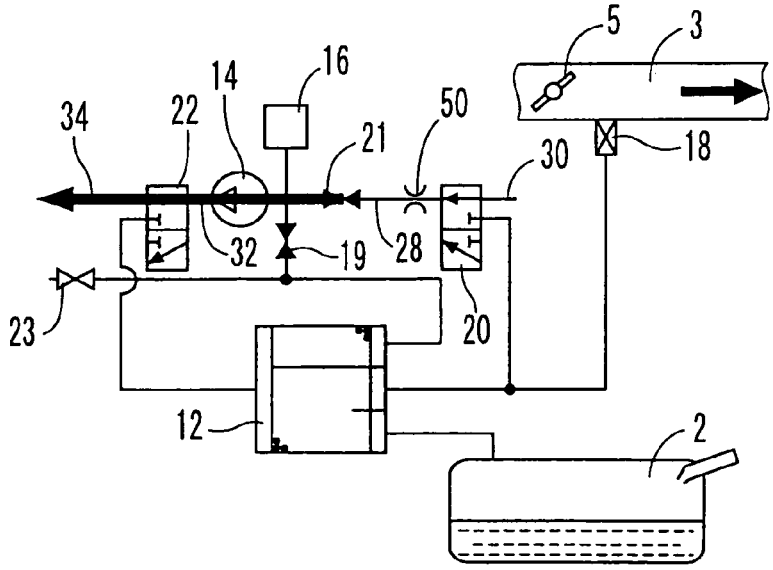
FIG. 9 is a schematic diagram describing the concentration measurement processing in FIG. 2.

Next, in step S202, while the pump 14 is being driven as is the case with step S201, the passage opening/closing valve 21 is brought into a closed state. With this, the respective valves 18 to 23 are brought into the states shown in FIG. 3 and hence the detection passage 28 is closed as shown in FIG. 9 and the pressure difference detected by the differential pressure sensor 16 is reduced to the shutoff pressure $P_t$ of the pump 14 as shown in FIG. 8. Then, in this step S202, when the pressure difference detected by the differential pressure sensor 16 becomes stable, the stable value is stored as the shutoff pressure $P_t$ of the pump 14 in the memory of the ECU 38. In this regard, in this step S202, air discharged from the pump 14 to the first discharge passage 32 by the time when the pressure difference detected by the differential pressure sensor 16 becomes stable is dissipated into the atmosphere through the filter 51 of the second atmosphere passage 34.

Figure 10:
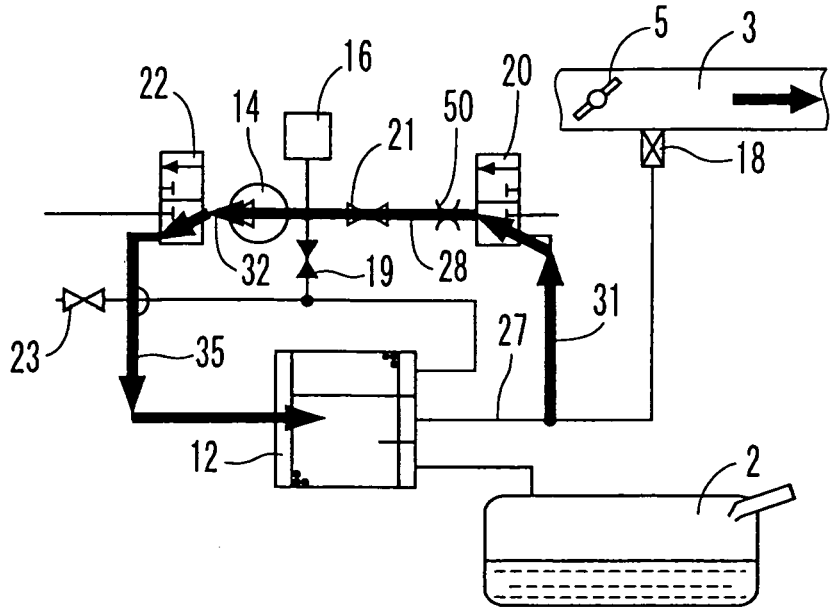
FIG. 10 is a schematic diagram describing the concentration measurement processing in FIG. 2.

Successively, in step S203, while the pump 14 is being driven as is the case with step S201, the passage changing valve 20 and the discharge changing valve 22 are brought into the second state and at the same time the passage opening/closing valve 21 is bought into a closed state. With this, the respective valves 18 to 23 are brought into the states shown in FIG. 3 and hence, as shown in FIG. 10, the air-fuel mixture flows from the branch passage 31 of the purge passage 27 into the detection passage 28 and the pressure difference detected by the differential pressure sensor 16 increases as shown in FIG. 8. Then, when the air-fuel mixture flowing into the detection passage 28 passes through the restrictor 50, the pressure difference detected by the differential pressure sensor 16 once stabilizes at a value $\Delta P_{Gas}$ related to the concentration "D" of fuel vapor. However, when the air-fuel mixture having passed through the restrictor 50 reaches the pump 14 and is sucked by the pump 14, as shown by a single dot and dash line in FIG. 8, the pressure difference detected by the differential pressure sensor 16 becomes unstable. Hence, in this step S203, after the air-fuel mixture passes through the restrictor 50 and hence the pressure difference detected by the differential pressure sensor 16 becomes stable, the stable value is stored as the pressure difference $\Delta P_{Gas}$ when the air-fuel mixture passes through the restrictor 50 in the memory of the ECU 38 before the air-fuel mixture reaches the pump 14, and then the routine proceeds to step S204.

In such step S203, it does not happen in principle that the air-fuel mixture is sucked by the pump 14 and is discharged into the first discharge passage 32. However, the time that elapses in step S302 after the detected pressure difference becomes stable until the routine proceeds to step S204 is previously set in such a way that the air-fuel mixture does not reach the pump 14. Hence, there is a possibility that the air-fuel mixture might reach the pump 14, for example, due to external disturbances. However, because the valves 20 to 22 are brought into the states shown in FIG. 3 in step S203, even in the unlikely event that the air-fuel mixture reaches the pump 14 and is discharged to the first discharge passage 32, the air-fuel mixture can be surely introduced into the canister 12 by the suction pressure (negative pressure) of the pump 14 applied to the first discharge passage 32 through the elements 28, 31, 27, 12, and 35.

In step S204, the pump 14 is stopped by the ECU 38 by the time when the air-fuel mixture having passed through the restrictor 50 reaches the pump 14. Further, in step S204 in this embodiment, the passage changing valve 20 and the discharge changing valve 22 are returned to the first state.

Thereafter, in step S205, the pressure differences $\Delta P_{Air}$ and $\Delta P_{Gas}$ stored in steps S201 and S203, the shutoff pressure $P_t$ stored in step S202, and the previously stored equation (13) are read from the memory of the ECU 38 to the CPU. Further, in step S205, the pressure differences $\Delta P_{Air}$, $\Delta P_{Gas}$ and the shutoff pressure $P_t$ are substituted into the equation (13) to compute the concentration "D" of fuel vapor and the computed value is stored in the memory.

Figure 11:
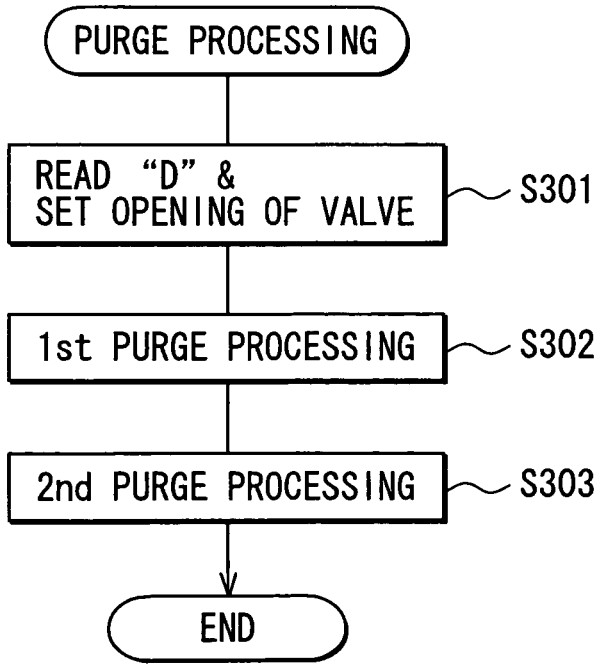
FIG. 11 is a flow chart describing purge processing in FIG. 2.

Up to this point, the concentration measurement processing has been described. Successively, the flow of purge processing in step S104 will be described on the basis of FIG. 11. Here, just before the purge processing, the states of the respective valves 18 to 23 are in the states realized in step S204 of the concentration measurement processing.

First, in step S301, the concentration "D" of fuel vapor stored in the step S205 of the concentration measurement processing is read from the memory of the ECU 38 to the CPU. Further, in step S301, the opening of the purge controlling valve 18 is set on the basis of the physical quantities expressing the state of the vehicle such as acceleration position and the like of the vehicle and the read concentration "D" of fuel vapor, and then the set value is stored in the memory.

Figure 12:
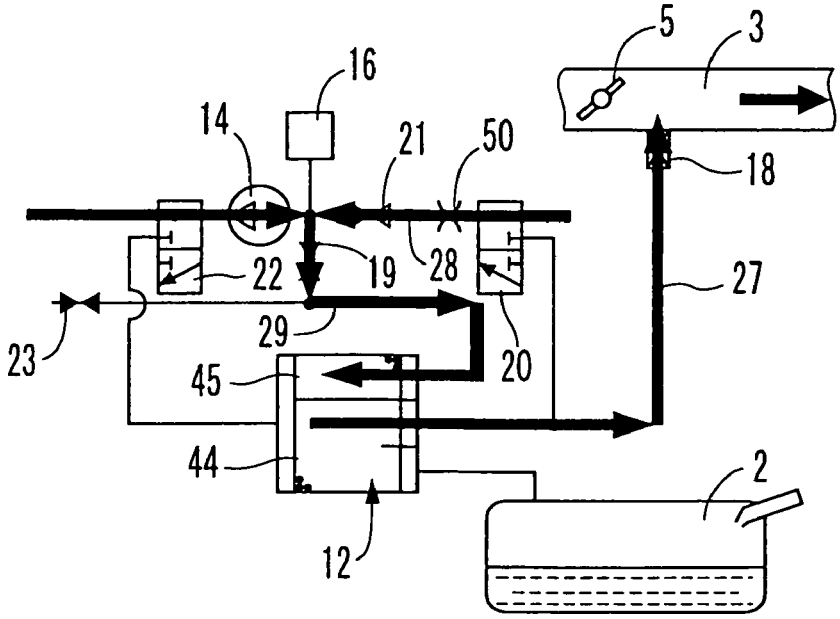
FIG. 12 is a schematic diagram describing the purge processing in FIG. 2.

Next, in step S302, the ECU 38 opens the purge controlling valve 18 and the connection controlling valve 19 and closes the canister closing valve 23 to carry out first purge processing. With this, because the valves 18 to 23 are brought into the states shown in FIG. 3, as shown in FIG. 12, the detection passage 28 and the first discharge passage 32 are open to the atmosphere and negative pressure in the intake passage 3 is applied to the elements 27, 12, 29, 28, and 14. Therefore, fuel vapor is desorbed from the main adsorption part 44 and is purged into the intake passage 3. Then, the air-fuel mixture remaining in the detection passage 28 by the concentration measurement processing flows into the subordinate adsorption part 45 and the fuel vapor in the air-fuel mixture is adsorbed by the subordinate adsorption part 45. In the first purge processing in step S302, it is aimed to discharge the remaining air-fuel mixture from the detection passage 28 in this manner. Then, the time required to carry out step S302, that is, the processing time $T_p$ required to carry out the first purge processing is set as, for example, the following (A) or (B).

(A) When it is assumed that the time required to carry out step S203 of the concentration measurement processing is $T_c$, the processing time $T_p$ is set such that $T_p \geqq T_p$. In steps S201 to S203 of the concentration measurement processing, because the suction pressure of the pump 14 is smaller than negative pressure in the intake passage 3, the remaining air-fuel mixture can be sufficiently purged from the detection passage 28 by setting the processing time $T_p$ in this manner.

(B) The longer one of the times $T_x$, $T_y$, which are required to purge the remaining air-fuel mixture from a portion closer to the pump 14 and a portion closer to the passage changing valve 20 than the connection portion of the transit passage 29 in the detection passage 28, respectively, is set at the processing time $T_p$. With this, the remaining air-fuel mixture can be sufficiently purged from the detection passage 28. Here, the purge time $T_x$ can be estimated by computing the flow rate $Q_x$ at the portion closer to the pump 14 than the connection portion of the transit passage 29 from the ratio of the pressure loss between at the portion closer to the pump 14 than the connection portion of the transit passage 29 and at the portion closer to the passage changing valve 20 than the connection portion of the transit passage 29 and by computing the ratio of the computed flow rate $Q_x$ to the volume $V_x$ of the portion closer to the pump 14 than the connection portion of the transit passage 29. Moreover, the purge time $T_y$ can be also estimated in the same manner.

In step S302, the set opening stored in the memory in step S301 is read by the CPU and the opening of the purge controlling valve 18 is controlled in such a way as to agree with the set opening. When the time $T_p$ elapses after step S302 is started, the routine proceeds to the next step s303.

Figure 13:
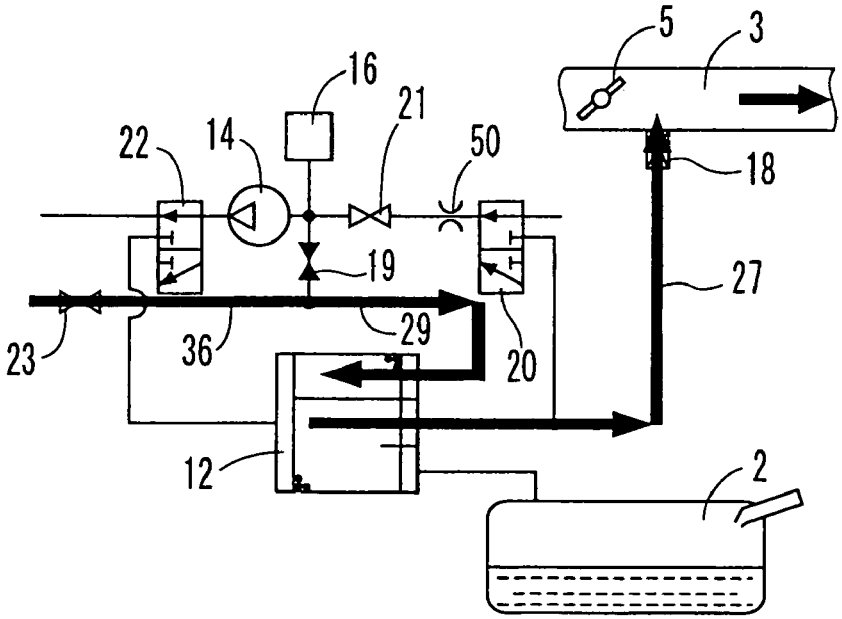
FIG. 13 is a schematic diagram describing the purge processing in FIG. 2.

In step S303, the ECU 38 closes the connection controlling valve 19 and opens the canister closing valve 23 to carry out second purge processing. With this, the valves 18 to 23 are brought into the states shown in FIG. 3 and hence, as shown in FIG. 13, the third atmosphere passage 36 and the subordinate adsorption part portion 29*b* of the transit passage 29 are open to the atmosphere and negative pressure in the intake passage 3 is applied to the elements 27, 12. Hence, fuel vapor is desorbed from the main adsorption part 44 and is purged into the intake passage 3. Here, also in step S303, as is the case with step S302, the set opening of the purge controlling valve 18 is read and the opening of the purge controlling valve 18 is controlled in such a way as to agree with the set opening. Moreover, when the purge stop conditions described above is established, step S303 is finished.

According to the first embodiment described above, in step S203 of the concentration measurement processing, after the air-fuel mixture passes through the restrictor 50 and hence the pressure difference detected by the pressure sensor 16 becomes stable, the stable value of the pressure difference is detected as pressure difference $\Delta P_{Gas}$ by the time when the air-fuel mixture reaches the pump 14. Hence, in step S205 of the concentration measurement processing, the concentration "D" of fuel vapor is computed on the basis of the stable value of pressure difference $\Delta P_{gas}$. As a result, it is possible to compute the concentration "D" of fuel vapor with accuracy.

Moreover, according to the first embodiment, the purge controlling valve 18 is closed in step S203 of the concentration measurement processing and hence the air-fuel mixture in the purge passage 27 is surely taken into the detection passage 28 and the pulsation of negative pressure in the intake passage 3 is not transmitted to the air-fuel mixture flowing into the detection passage 28. As a result, it is possible to reduce the detection error of the pressure difference $\Delta P_{Gas}$ caused by the deficient flow rate of the air-fuel mixture at the restrictor 50 and the transmission of pulsation.

Further, according to the first embodiment, because the number of revolutions of the pump 14 is controlled at a constant value in the concentration measurement processing, the pressure differences $\Delta P_{Air}$, $\Delta P_{Gas}$ and the shutoff pressure $P_t$ can be detected in a state where the P–Q characteristics of the pump 14 are stable. Therefore, it is possible to reduce such detection errors of the pressure difference $\Delta P_{Air}$, $\Delta P_{Gas}$ and the shutoff pressure $P_t$ that are caused by changes in the P–Q characteristics of the pump 14.

In this manner, according to the first embodiment, it is possible to detect the pressure difference $\Delta P_{Air}$, $\Delta P_{Gas}$ and the shutoff pressure $P_t$ with accuracy in the concentration measurement processing and hence to improve the accuracy of computing the concentration "D" of fuel vapor.

Still further, according to the first embodiment, as shown in FIG. 8, the shutoff pressure $\Delta P_t$ becomes larger than the pressure difference $\Delta P_{Air}$. Hence, according to the concentration measurement processing in which the step S202 where the shutoff pressure $\Delta P_t$ is detected is carried out successively after the step S201 where the pressure difference $\Delta P_{Air}$ is detected, the total time of the times required to stabilize the pressure difference detected by the differential pressure sensor 16 in the respective steps can be made shorter than the total time in the opposite case. Moreover, in step S202 of the concentration measurement processing, the detection passage 28 is closed between the restrictor 50 and the pump 14. This can also make it possible to stabilize the pressure difference detected by the differential pressure sensor 16.

Still further, according to the first embodiment, the concentration measurement processing is employed in which the pressure difference $\Delta P_{Gas}$ is detected in the step S203 after the detection of the pressure difference $\Delta P_{Air}$, $\Delta P_{Gas}$ and the shutoff pressure $P_t$. Hence, the air-fuel mixture used for detecting the pressure difference $\Delta P_{Gas}$ does not remain in the detection passage 28 when the pressure difference $\Delta P_{Air}$ and the shutoff pressure $P_t$ are detected. Therefore, the time required to stabilize the pressure difference detected by the differential pressure sensor 16 when the pressure difference $\Delta P_{Air}$ and the shutoff pressure $P_t$ are detected is not elongated by the air-fuel mixture in the detection passage 28. In addition, in step S203, the detection of the pressure difference $\Delta P_{Gas}$ is finished before the air-fuel mixture having passed through the restrictor 50 reaches the pump 14. Therefore, it is possible to shorten the time required to carry out step S203.

In this manner, according to the first embodiment, the steps S201 to S203 of the concentration measurement processing can be carried out within a short time and hence the total time required to carry out the concentration measurement processing can be shortened. With this, it is possible to increase time for the purge processing and hence to sufficiently secure the actual quantity of purge.

In addition, according to the first embodiment, in step S204 carried out after the detection of the pressure difference $\Delta P_{Gas}$ in the concentration measurement processing, the pump 14 is stopped by the time when the air-fuel mixture reaches the pump 14 and hence the air-fuel mixture is resistant to reaching the pump 14. As a result, it is possible to prevent the air-fuel mixture from being sucked by the pump 14 to make an effect on the following concentration measurement processing.

In more addition, according to the first embodiment, in the first purge processing carried out after the concentration measurement processing, the purge controlling valve 18 and the connection controlling valve 19 are opened and hence negative pressure in the intake passage 3 is applied to the detection passage 28 to introduce the air-fuel mixture remaining in the detection passage 28 into the subordinate adsorption part 45, that is, to purge the remaining air-fuel mixture from the detection passage 28. Hence, it is possible to avoid a trouble that the fuel vapor taken into the detection passage 28 by the preceding concentration measurement processing makes an effect on the following concentration measurement processing. Moreover, the fuel vapor adsorbed by the subordinate adsorption part 45 in the first purge processing reaches the main adsorption part 44 after some period of time because of the existence of the space 48. With this, in the first purge processing, the fuel vapor desorbed from the main adsorption part 44 and introduced into the purge passage 27 is not increased. As a result, it is possible to prevent the actual concentration of purge in the first purge processing from being deviated from the computed value D in the concentration measurement processing just before the first purge processing.

In addition, according to the first embodiment, after the main operation is finished, the connection controlling valve 19 is commonly closed. As a result, it is possible to prevent the fuel vapor adsorbed by the subordinate adsorption part 45 by the first purge processing from being desorbed after the main operation is finished to reach the detection passage 28 by mistake. Therefore, it is possible to avoid a trouble that the fuel vapor desorbed from the subordinate adsorption part 45 makes an effect on the following concentration measurement processing.

In the first embodiment described above, the first atmosphere passage 30 corresponds to "atmosphere passage" as claimed in claims, the passage changing valve 20 corresponds to "passage changing means" as claimed in claims, the differential pressure sensor 16 corresponds to "differential pressure detecting means" as claimed in claims, and the ECU 38 corresponds to "concentration computing means" as claimed in claims. Moreover, in the first embodiment, the connection controlling valve 19 corresponds to "connection controlling means" as claimed in claims, the portion 29*a* closer to the detection passage 28 of the transit passage 29 corresponds to "a first transit passage" as claimed in claims, the portion 29*b* closer to the subordinate adsorption part of the transit passage 29 corresponds to "a second transit passage" as claimed in claims. Furthermore, in the first embodiment, the subordinate adsorption part 45 corresponds to "a first adsorption part" as claimed in claims, the main adsorption part 44 corresponds to "a second adsorption part" as claimed in claims, the purge controlling valve 18 corresponds to "purge controlling means" as claimed in claims, and the ECU 38 corresponds to "pump controlling means" as claimed in claims. In addition, in the first embodiment, the passage opening/closing valve 21 corresponds to "passage opening/closing means" as claimed in claims, the pressure difference $\Delta P_{Air}$ corresponds to "a first pressure difference" as claimed in claims, and the pressure difference $\Delta P_{Gas}$ corresponds to "a second pressure difference" as claimed in claims.

Second Embodiment

Figure 14A:
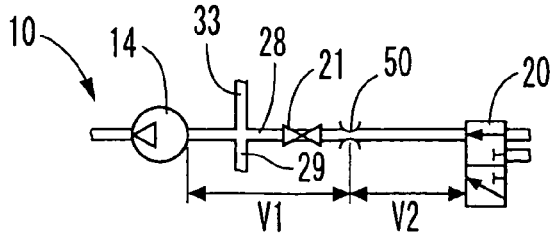
FIGS. 14A and 14B are construction diagrams showing the main portion of a fuel vapor processing apparatus according to a second embodiment.
Figure 14B:
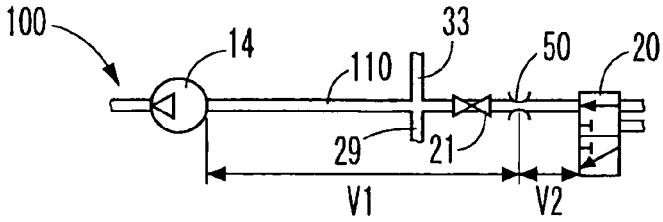

As shown in FIG. 14, a second embodiment of the present invention is a modification of the first embodiment. The substantially same constituent parts as parts in the first embodiment will be denoted by the same reference symbols and their descriptions will be omitted.

In a fuel vapor processing apparatus 100 of the second embodiment, the length of a detection passage 110 between the pump 14 and the restrictor 50 is made longer than that in the first embodiment to expand the passage volume of the detection passage 110. Hereinafter, the reason why such construction is employed will be described.

Figure 15:
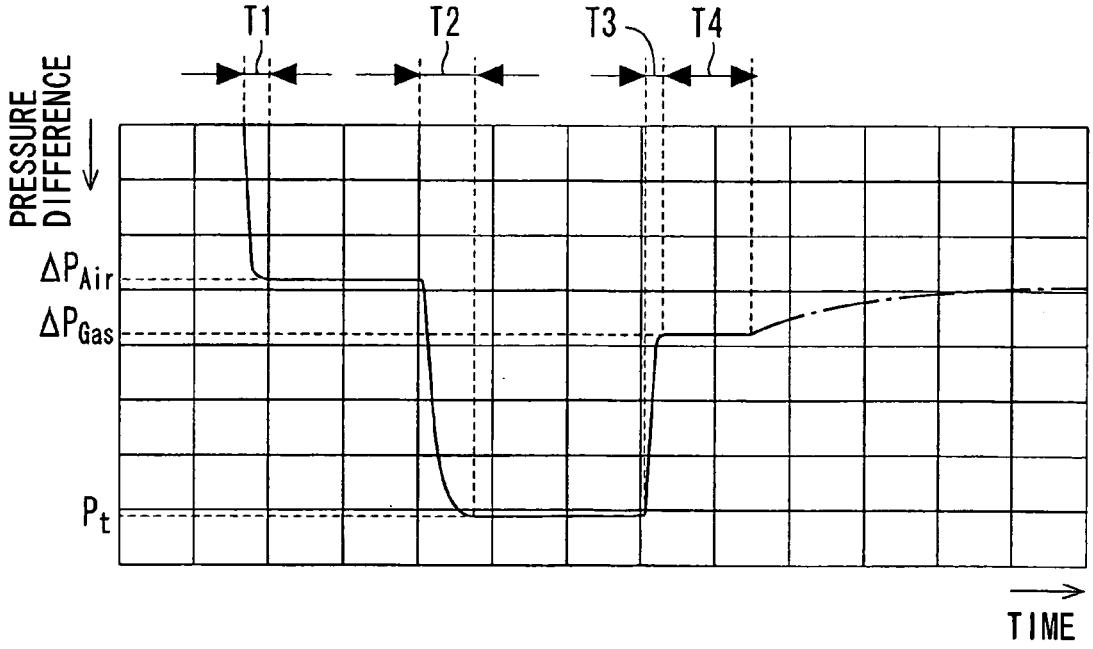
FIG. 15 is a characteristic graph describing the concentration measurement processing of the fuel vapor processing apparatus according to the second embodiment.
Figure 16A:
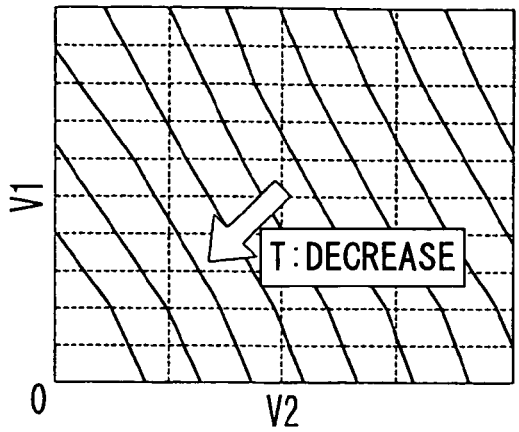
FIGS. 16A to 16C are characteristic graphs describing the concentration measurement processing of the fuel vapor processing apparatus according to the second embodiment.

In the respective steps S201, S202, and S203 of the concentration measurement processing, as shown in FIG. 15, specified times T1, T2, and T3 are required after the processing is started by the time when the pressure difference detected by the differential pressure sensor 16 stabilizes. Then, the total time T of these times T1, T2, and T3 has the correlation as shown in FIG. 16A with respect to a first volume V1 from the restrictor 50 to the pump 14 of the detection passage 110 and a second volume V2 from the restrictor 50 to the passage opening/closing valve 21 of the detection passage 110. That is, the total time T decreases as the first volume V1 and the second volume V2 become smaller. Here, as the total time T becomes shorter, the total time required to measure the concentration of fuel vapor becomes shorter.

Figure 16B:
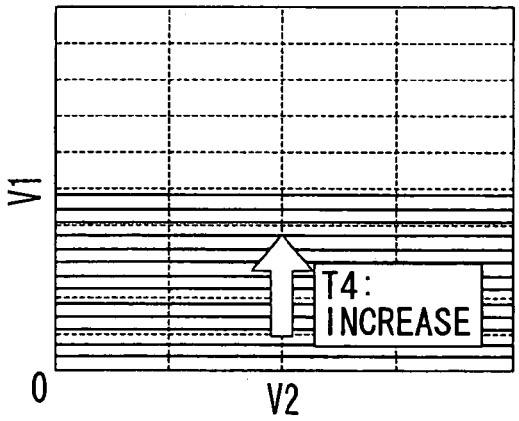

Moreover, in step S203 of the concentration measurement processing, the time T (refer to FIG. 15) during which the pressure difference detected by the differential pressure sensor 16 tends to be stable after the air-fuel mixture passes through the restrictor 50 has the correlation as shown in FIG. 16B with respect to the first volume V1 and the second volume V2. That is, the stable time T4 does not depend on the second volume V2 but increases as the first volume V1 increases. Here, the stable time T4 is said to be the time required to determine the stable value $\Delta P_{Gas}$ of the pressure difference and hence as the time T4 is longer, the accuracy of detecting the pressure difference $\Delta P_{Gas}$ becomes more accurate.

Figure 16C:
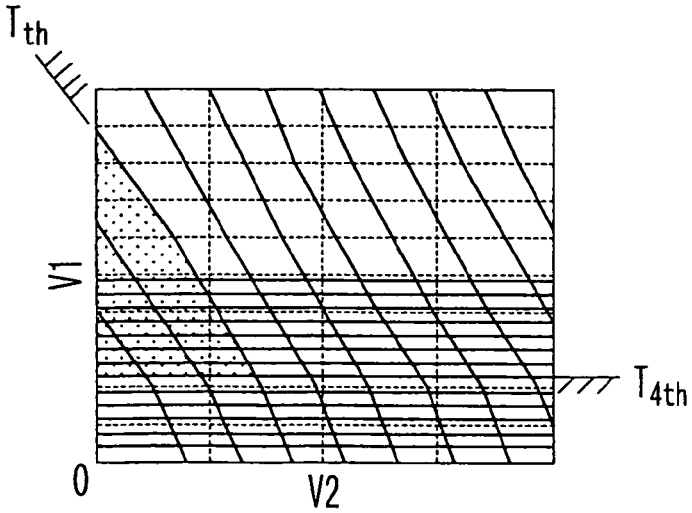

In this manner, it is found that the total time T and the stable time T4 are in an opposite relation with respect to the first volume V1. Then, in the second embodiment, as shown in FIG. 16C, the first volume V1 is set at as large a value as possible and the second volume V2 is set at as small a value as possible within an optimal range where the total time T is less than a limit time $T_{th}$ and where the stable time T4 is not less than a necessary time $T4_{th}$. Hence, in the second embodiment, in particular, to expand the first volume V1, the length between the elements 14 and 50 of the detection passage 110 is elongated. Here, the limit time $T_{th}$ and the necessary time $T4_{th}$ are values determined appropriately so as to secure the time required to carry out the purge processing.

According to the second embodiment like this, the detection passage 110 is elongated to expand the first volume V1 and hence the stable time T4 can be secured within a range where it does not have a large effect on the time required to carry out the purge processing. As a result, it is possible to improve the accuracy of detecting the pressure difference the $\Delta P_{Gas}$ and by extension the accuracy of computing the concentration "D" of fuel vapor. In addition, because the respective volumes V1, V2 of the detection passage 110 are set in such a way that the time T required to stabilize the pressure difference detected by the differential pressure sensor 16 is not elongated extremely, it is possible to improve the effect of shortening the total time required to measure the concentration of fuel vapor.

In the above-mentioned second embodiment, a portion from the restrictor 50 to the pump 14 of the detection passage 110 corresponds to "volume part" as claimed in claims.

Third to Fifth Embodiments

Figure 17:
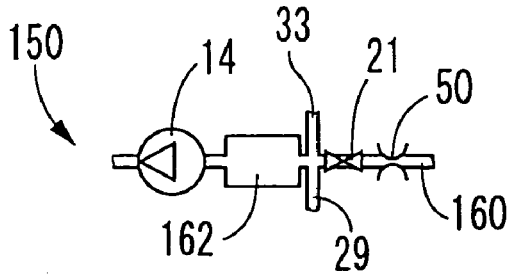
FIG. 17 is a construction diagram showing the main portion of a fuel vapor processing apparatus according to a third embodiment.
Figure 18:
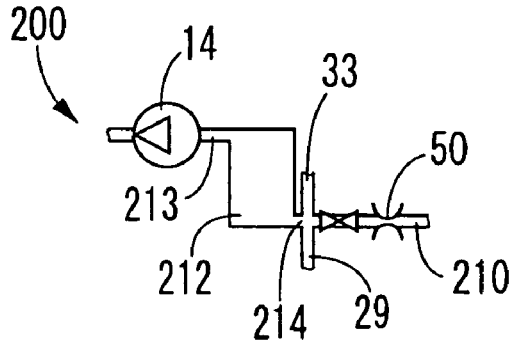
FIG. 18 is a construction diagram showing the main portion of a fuel vapor processing apparatus according to a fourth embodiment.
Figure 19:
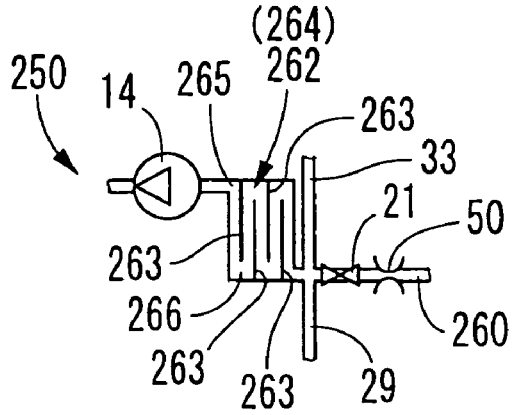
FIG. 19 is a construction diagram showing the main portion of a fuel vapor processing apparatus according to a fifth embodiment.

As shown in FIG. 17 to FIG. 19, third to firth embodiments of the present invention are modifications of the second embodiment. The substantially same constituent parts as parts in the first embodiment will be denoted by the same reference symbols and their descriptions will be omitted.

In fuel vapor processing apparatuses 150, 200, 250 of the third to fifth embodiments, the first volume V of detection passages 160, 210, 260 are expanded by structures different from that of the second embodiment.

Specifically, in the third to fifth embodiments, the passage areas of the detection passages 160, 210, 260 are expanded between the pump 14 and the restrictor 50, to be more detailed, between the pump 14 and the connection portion of the transit passage 29 to expand the first volume V1. Hence, there can be produced the same effect as in the second embodiment. Here, the portions 162, 212, 262 (hereinafter simply referred to as "expanded portion") whose passage areas are expanded in the detection passages 160, 210, 260 are arranged closer to the pump 14 than the connection portion of the transit passage 29. Hence, this can enhance the capability of purging in step S302 of the purge processing.

In the third to fifth embodiments described above, the expanded portions 162, 212, 262 of the detection passages 160, 210, 260 correspond to "volume part" as claimed in claims.

Further, in the fourth embodiment, portions 213, 214 on both sides of the expanded portion 212 of the detection passage 210 are arranged separately on the up and down sides. With this, the portion 213 connecting with the pump 14 side of the expanded portion 212 is arranged above the portion 214 connecting with the passage opening/closing valve 21 (restrictor 50) side of the expanded portion 212. Here, because the specific gravity of hydrocarbon HC evaporating from gasoline fuel relative to air is larger than 1, an air-fuel mixture containing the HC decreases in speed when it flows in the expanded portion 212 toward the pump 14. Such a decrease in flowing speed increases the stable time T4 and hence can contribute to an improvement in the accuracy of computing the concentration "D" of fuel vapor.

In the third to forth embodiment described above, the respective portions 214, 213, 212 correspond to "a first connection part," "a second connection part," and "a third connection part" as claimed in claims.

Meanwhile, in the fifth embodiment, the expanded portion 262 of the detection passage 260 is partitioned by multiple partition walls 263 to form a meandering portion 264. This meandering portion 264 meanders up and down. Hence, the air-fuel mixture containing HC heavier than air decreases in speed when it flows upward in the meandering portion 264. In particular, in the fifth embodiment, the pump side end portion 265 of the meandering portion 264 is arranged above the meandering portion 266 closest to the end portion 265, the air-fuel mixture surely decreases in speed when it flows from the meandering portion 266 to the end portion 265. Such a decrease in speed increases the stable time T4 and hence can contribute to an improvement in the accuracy of computing the concentration "D" of fuel vapor.

Sixth Embodiment

Figure 20:
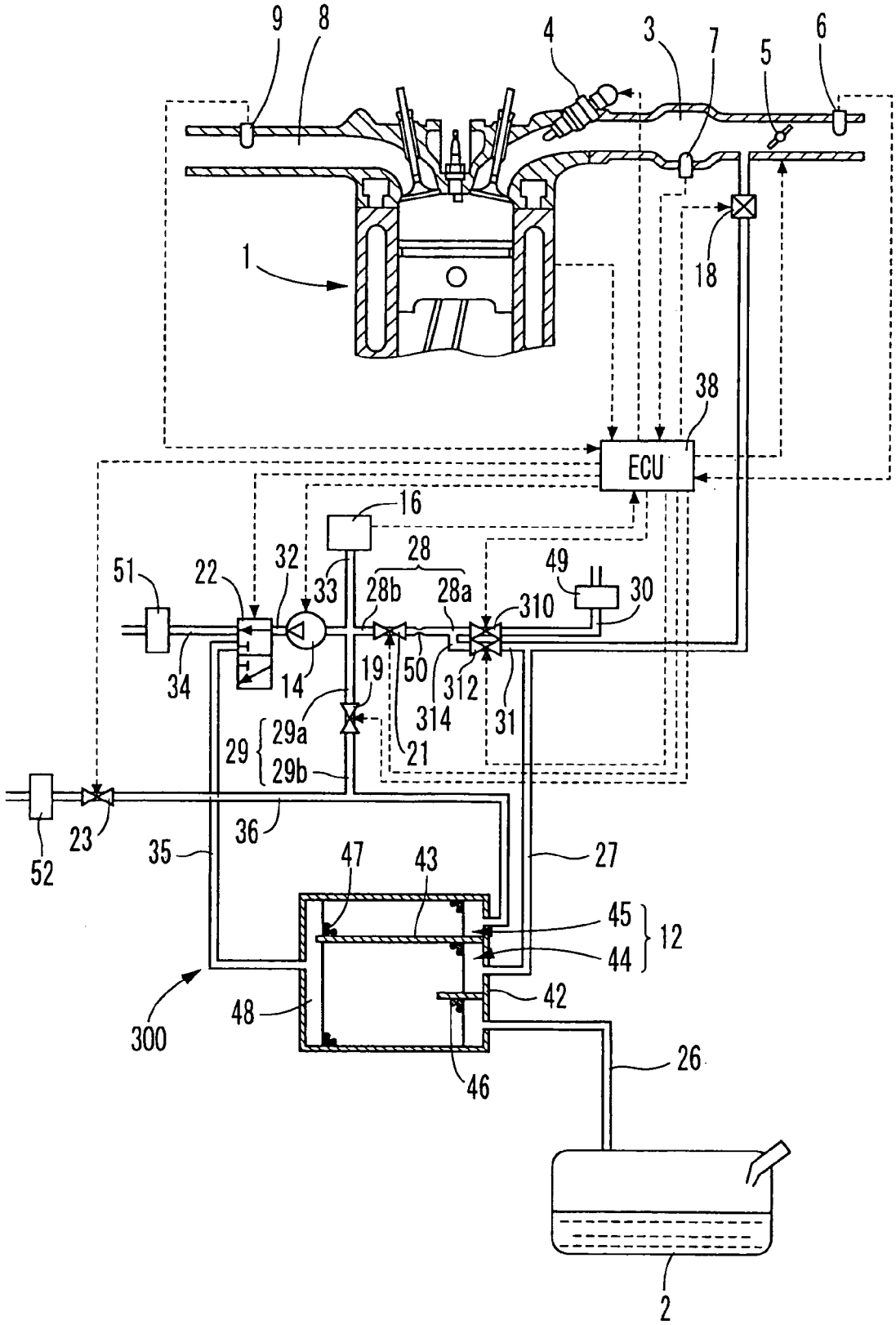
FIG. 20 is a construction diagram showing a fuel vapor processing apparatus according to a sixth embodiment.

As shown in FIG. 20, a sixth embodiment of the present invention is a modification of the first embodiment. The substantially same constituent parts as parts in the first embodiment will be denoted by the same reference symbols and their descriptions will be omitted.

In a fuel vapor processing apparatus 300 of the sixth embodiment, in place of the passage changing valve 20 made of a three-way valve, passage connecting valves 310, 312 made of an electromagnetically driven type two-way valve are electrically connected to the ECU 38.

Specifically, a first passage connecting valve 310 is connected to the first atmosphere passage 30 and an end opposite to the pump 14 of the detection passage 28. The first passage connecting valve 310 connected in this manner is opened or closed to control the connection between the first atmosphere passage 30 and the detection passage 28. Hence, in a state where the first passage connecting valve 310 is opened, air can flow into the detection passage 28 through the first atmosphere passage.

A second passage connecting valve 312 is connected to the branch passage 31 of the purge passage 27. Moreover, the second passage connecting valve 312 is connected to a branch passage 314 branched from the detection passage 28 between the first passage connecting valve 310 and the restrictor 50. The second passage connecting valve 312 connected in this manner is opened or closed to control the connection between the respective branch passages 31, 314 of the purge passage 27 and the detection passage 28. Hence, in a state where the second passage connecting valve 312 is opened, the air-fuel mixture in the purge passage 27 can flow into the detection passage 28 through the branch passage 31.

In the sixth embodiment like this, by carrying out the main operation and the canister opening operation in the first embodiment in such a way as to change the respective valves 18, 19, 21 to 23, 310 and 312 into the states shown in FIG. 21, the same working and effect as those in the first embodiment can be produced.

In the sixth embodiment described above, a set of the first and second passage connecting valves 310, 312 correspond to "passage changing means" as claimed in claims.

Figure 22:
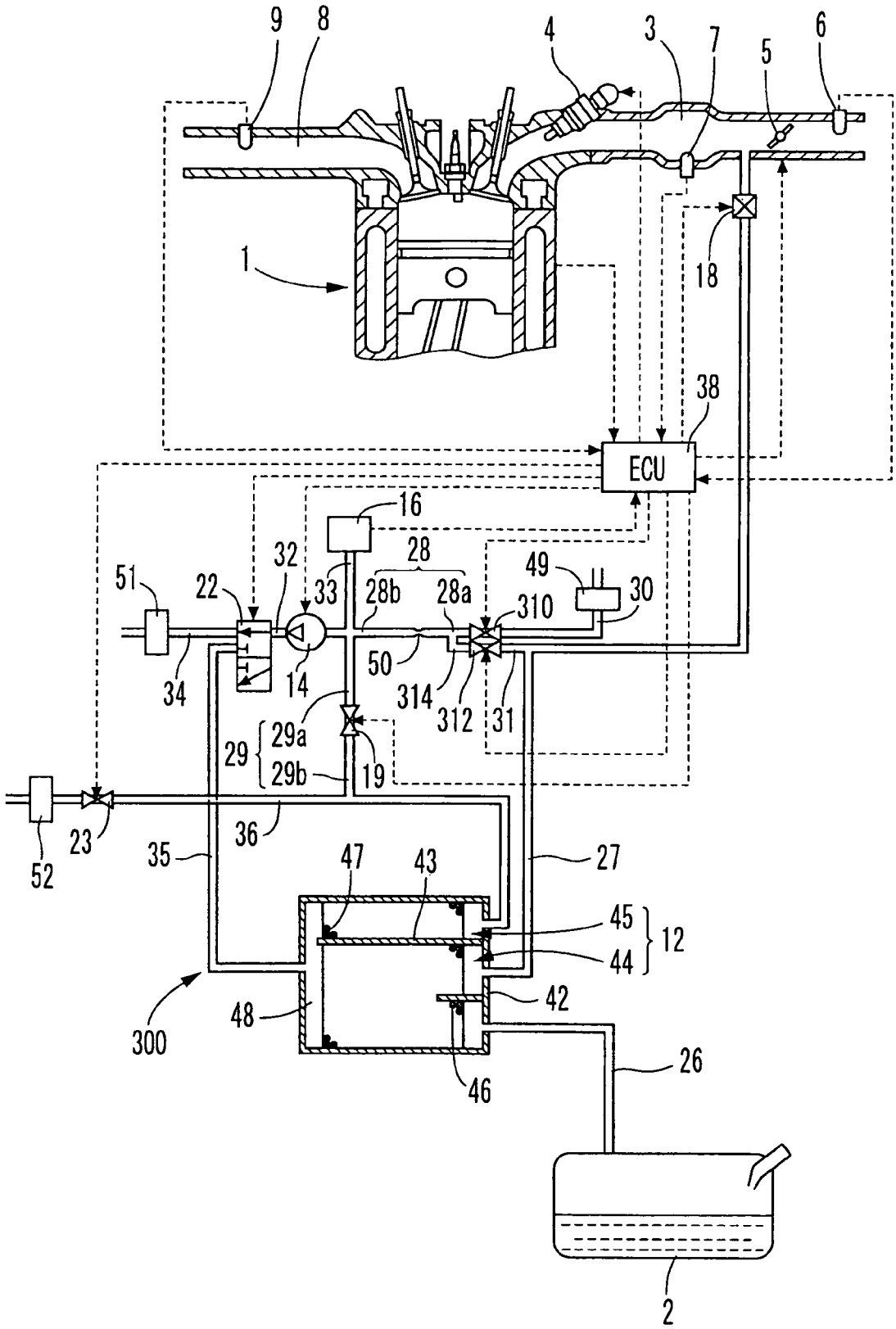
FIG. 22 is a construction diagram showing a fuel vapor processing apparatus according to a modification of the sixth embodiment.

In the sixth embodiment, it is also recommended that the passage opening/closing valve 21 is not provided as shown by a modification in FIG. 22. In this case, by carrying out the main operation and the canister opening operation in the first embodiment in such a way as to change the respective valves 18, 19, 22, 23, 310 and 312 into the states shown in FIG. 23, the same working and effect as those in the first embodiment can be produced.

Seventh Embodiment

Figure 24:
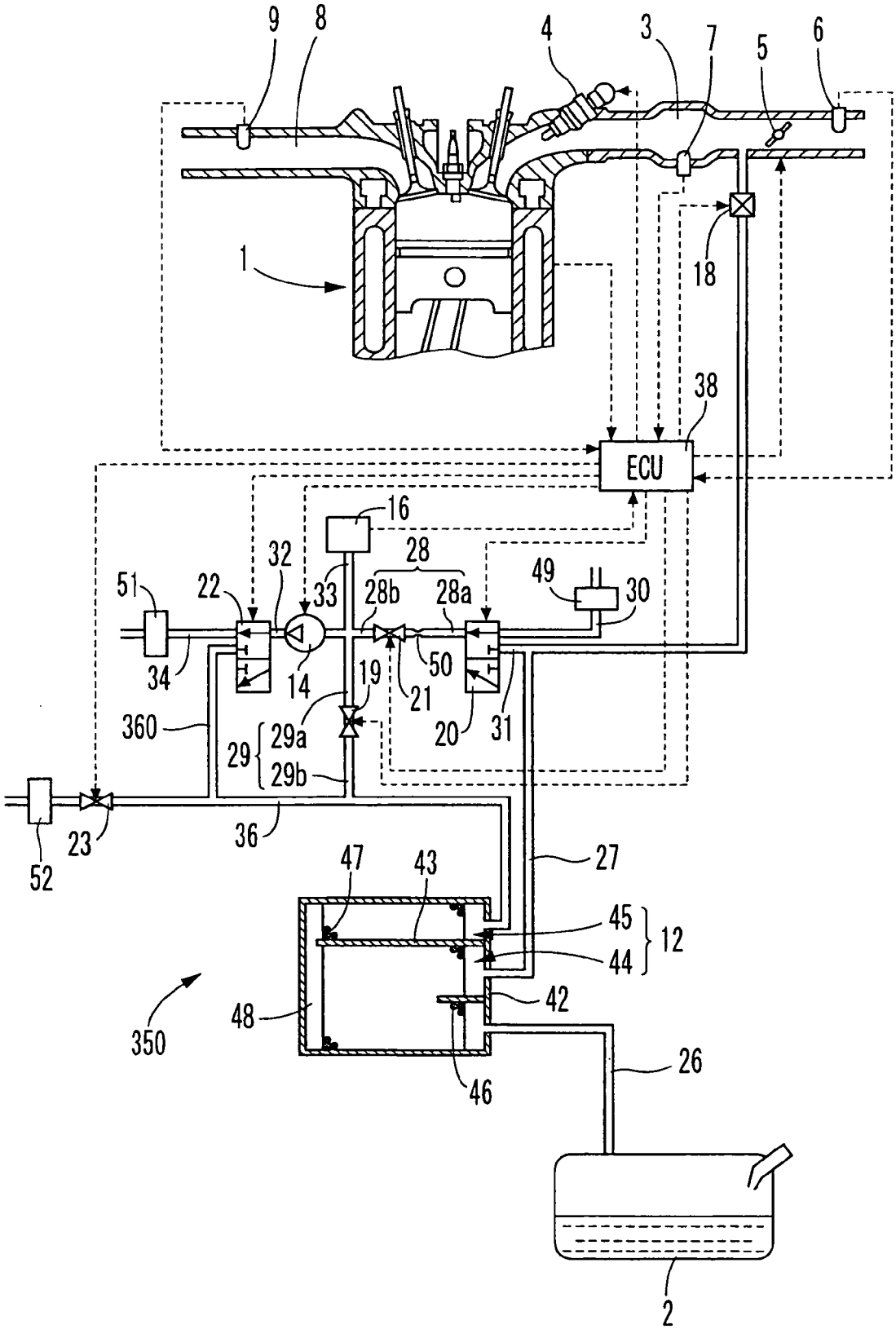
FIG. 24 is a construction diagram showing a fuel vapor processing apparatus according to a seventh embodiment.

As shown in FIG. 24, a seventh embodiment of the present invention is a modification of the first embodiment. The substantially same constituent parts as parts in the first embodiment will be denoted by the same reference symbols and their descriptions will be omitted.

In a fuel vapor processing apparatus 350 of the seventh embodiment, a second discharge passage 360 connected to the discharge changing valve 22 connects with a portion closer to the transit passage 29 than the canister closing valve 23 of the third atmosphere passage 36. Hence, in the second state of the discharge changing valve 22, the discharge gas from the pump 14 can flow into the subordinate adsorption part 45 of the canister 12 via the first discharge passage 32, the second discharge passage 360, the third atmosphere passage 36, and the transit passage 29.

In the seventh embodiment like this, by carrying out the main operation and the canister opening operation in the first embodiment in such a way as to change the respective valves 18 to 23 into the states shown in FIG. 25, the same working and effect as in the first embodiment can be produced.

Eighth Embodiment

Figure 26:
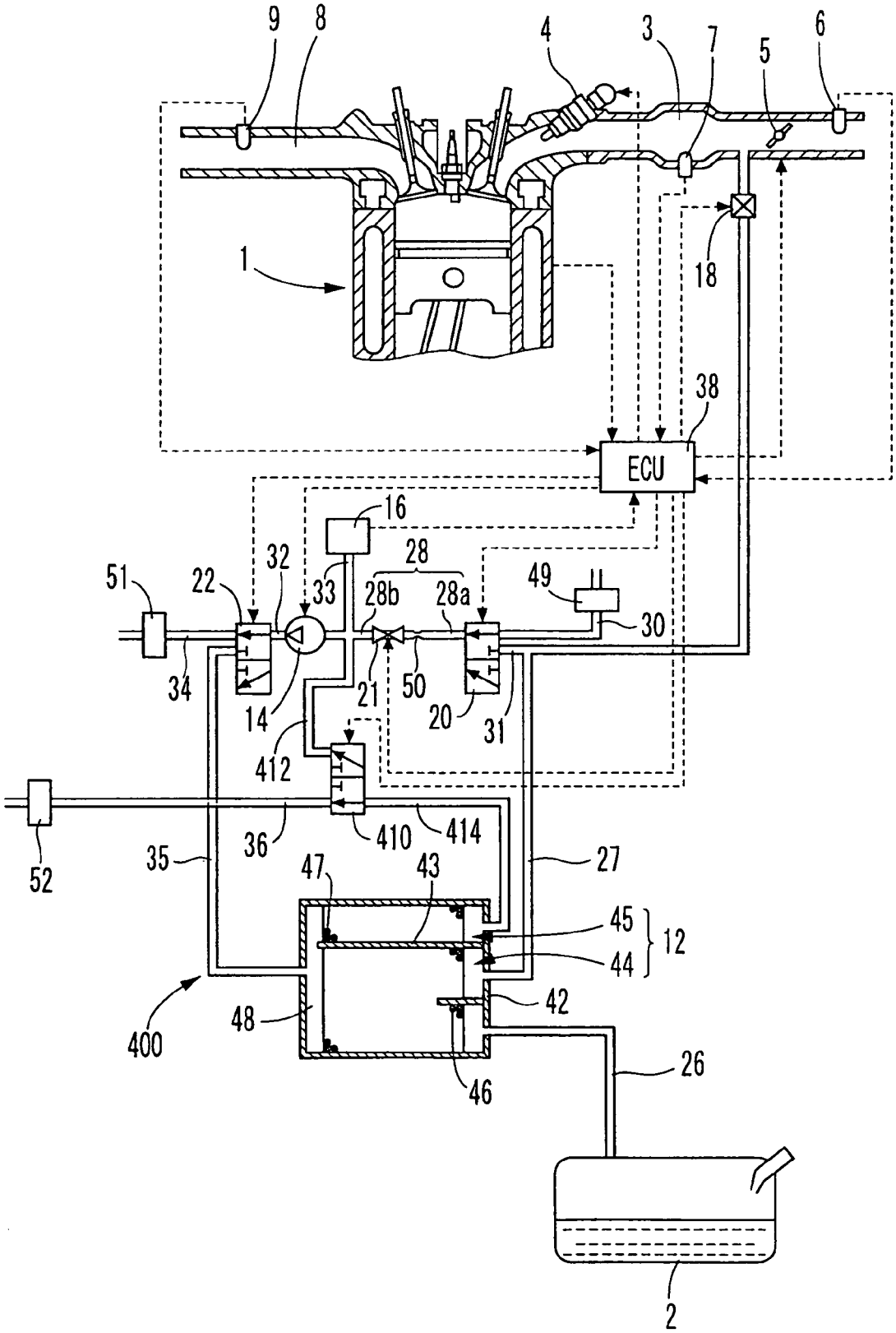
FIG. 26 is a construction diagram showing a fuel vapor processing apparatus according to an eighth embodiment.

As shown in FIG. 26, an eighth embodiment of the present invention is a modification of the first embodiment. The substantially same constituent parts as parts in the first embodiment will be denoted by the same reference symbols and their descriptions will be omitted.

In a fuel vapor processing apparatus 400 of the eighth embodiment, in place of the connection controlling valve 19 and the canister closing valve 23 both of which are two-way valves, a connection changing valve 410 made of an electromagnetically driven type three-way valve is electrically connected to the ECU 38.

Specifically, the connection changing valve 410 is connected to a first transit passage 412 connecting with the detection passage 28 in place of the transmit passage 29 between the passage opening/closing valve 21 (restrictor 50) and the pump 14. Moreover, the connection changing valve 410 is connected to an end opposite to an open end of the third atmosphere passage 36. Furthermore, the connection changing valve 410 is connected to a second transit passage 414 connecting with the subordinate adsorption part 45 in place of the transit passage 29. The connection changing valve 410 connected in this manner changes a passage connecting with the second transit passage 414 between the first transit passage 412 and the third atmosphere passage 36. Hence, in the first state where the third atmosphere passage 36 connects with the second transit passage 414, the subordinate adsorption part 45 is open to the atmosphere through these passages 36, 414. Moreover, in the second state where the first transit passage 412 connects with the second transit passage 414, when the purge controlling valve 18 is opened, such negative pressure in the intake passage 3 that is applied to the subordinate adsorption part 45 is applied also to the second transit passage 414, the first transit passage 412, and the detection passage 28. Hence, when the negative pressure is applied to the subordinate adsorption part 45 in a state where the air-fuel mixture exists in the detection passage 28, the air-fuel mixture in the detection passage 28 flows into the subordinate adsorption part 45 through the first and second transit passages 412, 414.

In the eighth embodiment like this, by carrying out the main operation and the canister opening operation in the first embodiment in such a way as to change the respective valves 18, 20 to 22, 410 into the states shown in FIG. 27, the same working and effect as those in the first embodiment can be produced.

In the eighth embodiment described above, the connection changing valve 410 corresponds to "connection controlling means" as claimed in claims.

Ninth Embodiment

Figure 28:
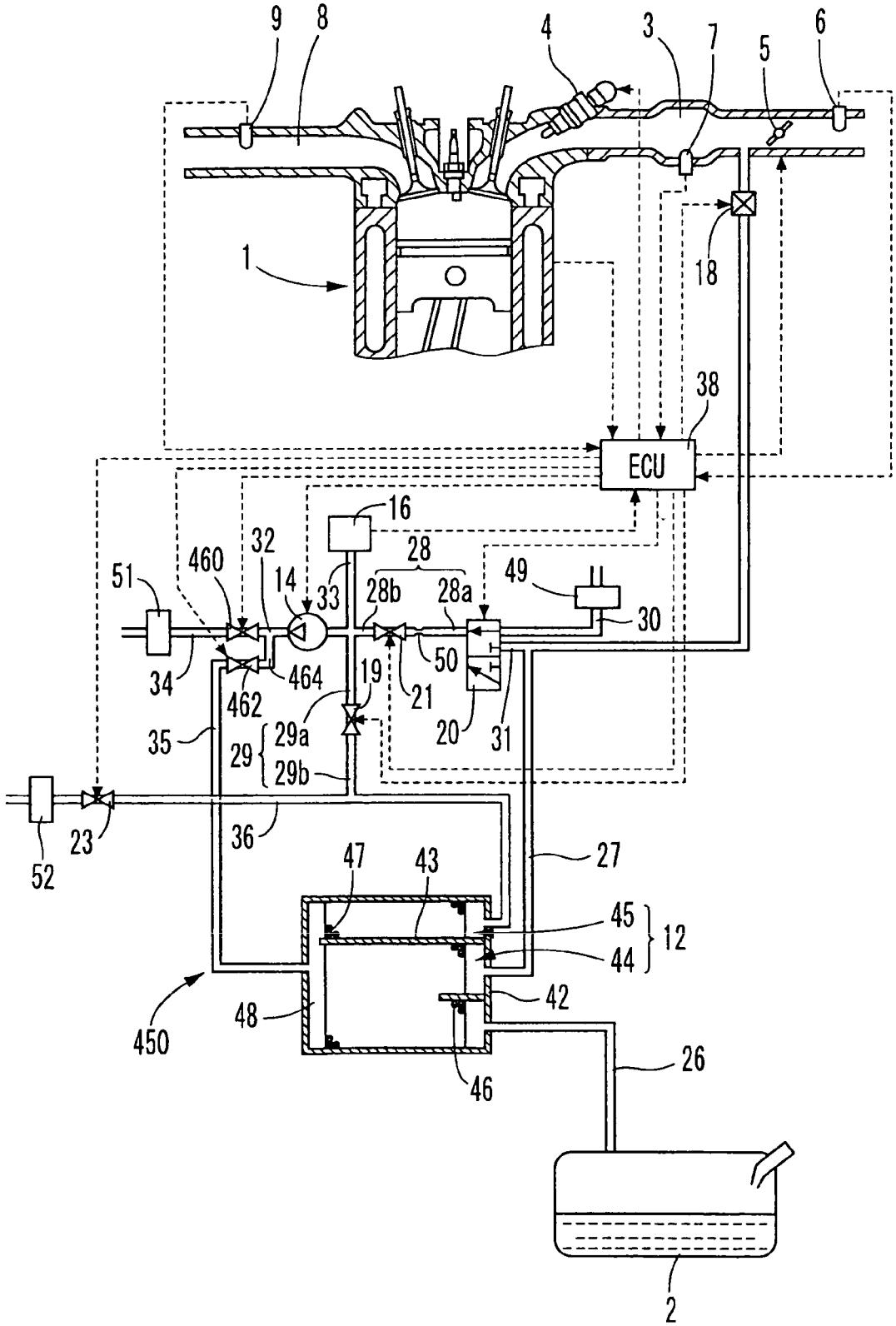
FIG. 28 is a construction diagram showing a fuel vapor processing apparatus according to a ninth embodiment.

As shown in FIG. 28, a ninth embodiment of the present invention is a modification of the first embodiment. The substantially same constituent parts as parts in the first embodiment will be denoted by the same reference symbols and their descriptions will be omitted.

In a fuel vapor processing apparatus 450 of the ninth embodiment, in place of the discharge changing valve 22 made of a three-way valve, discharge connecting valves 460, 462 made of an electromagnetically driven type two-way valve are electrically connected to the ECU 38.

Specifically, a first discharge connecting valve 460 is connected to an end opposite to an open end of the second atmosphere passage 34 and the first discharge passage 32 on the discharge side of the pump 14. The first discharge connecting valve 460 connected in this manner is opened or closed to control the connection between the second atmosphere passage 34 and the first discharge passage 32. Hence, in a state where the first discharge connecting valve 460 is opened, gas discharged from the pump 14 is dissipated to the atmosphere through the first discharge passage 32 and the second atmosphere passage 34.

A second discharge connecting valve 462 is connected to the second discharge passage 35 and a branch passage 464 branched from the middle portion of the first discharge passage 32. The second discharge connecting valve 462 connected in this manner is opened or closed to control the connection between the second discharge passage 35 and the branch passage 464 of the first discharge passage 32. Hence, in a state where the second discharge connecting valve 462 is opened, gas discharged from the pump 14 can flow into the space 48 in the canister 12 through the first discharge passage 32 and the second discharge passage 35.

In the ninth embodiment like this, by carrying out the main operation and the canister opening operation in the first embodiment in such a way as to change the respective valves 18 to 21, 23, 460, 462 into the states shown in FIG. 29, the same working and effect as those in the first embodiment can be produced.

Tenth Embodiment

Figure 30:
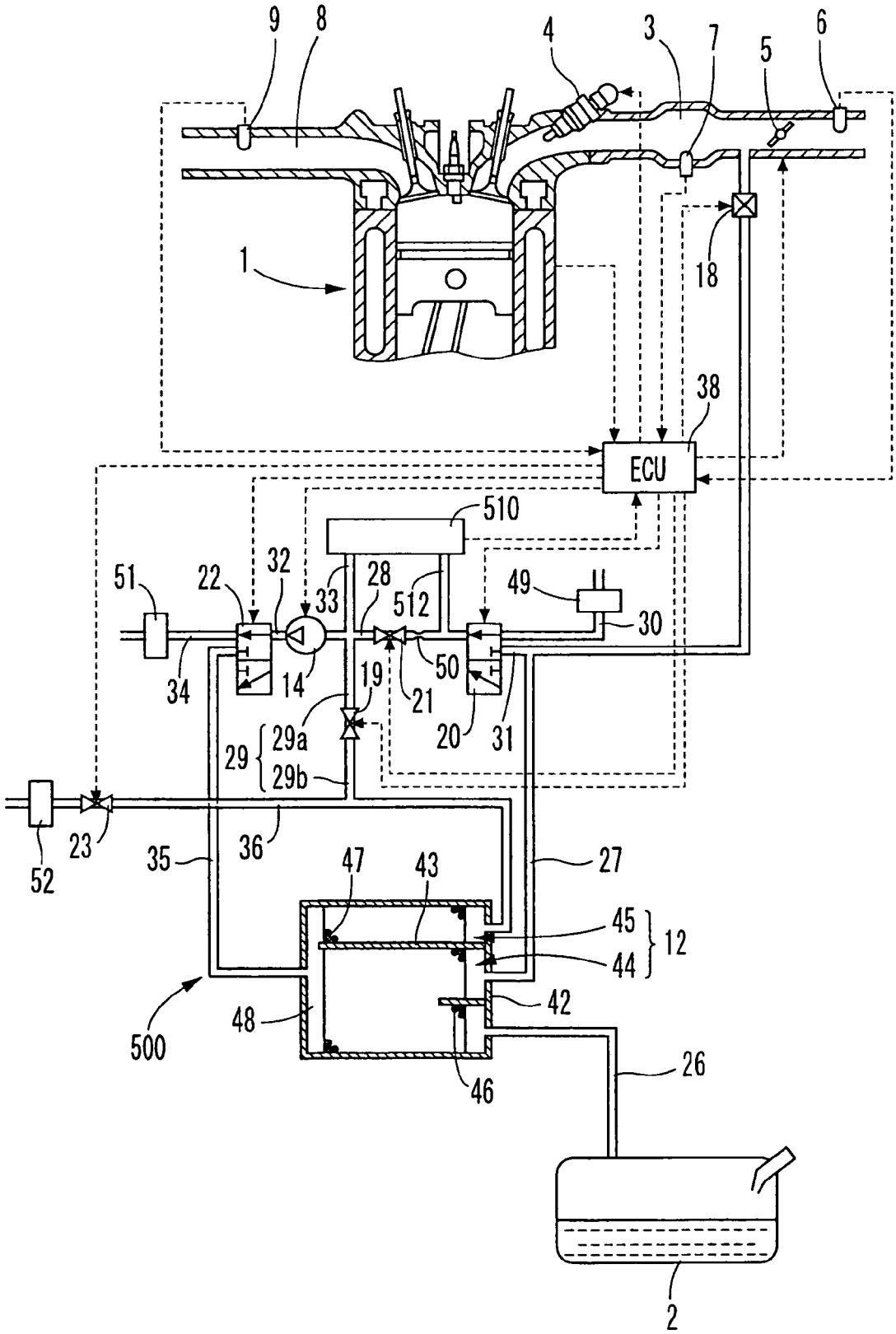
FIG. 30 is a construction diagram showing a fuel vapor processing apparatus according to a tenth embodiment.

As shown in FIG. 30, a tenth embodiment of the present invention is a modification of the first embodiment. The substantially same constituent parts as parts in the first embodiment will be denoted by the same reference symbols and their descriptions will be omitted.

In a fuel vapor processing apparatus 500 of the tenth embodiment, a differential pressure sensor 510 electrically connected to the ECU 38 connects with not only the pressure introducing passage 33 but also a pressure introducing passage 512 branched from the detection passage 28 between the passage changing valve 20 and the restrictor 50. With this, the differential pressure sensor 510 detects the pressure difference between pressure receiving through the pressure introducing passage 33 from a portion closer to the pump 14 than the restrictor 50 of the detection passage 28 and pressure receiving through the pressure introducing passage 512 from a portion closer to the passage changing valve 20 than the restrictor 50 of the detection passage 28. Hence, the pressure difference detected by the differential pressure sensor 510 when the pump 14 is operated is substantially equal to the pressure difference between both ends of the restrictor 50 in a state where the passage opening/closing valve 21 is opened. Moreover, in a state where the passage opening/closing valve 21 is closed and where the passage changing valve 20 is in the first state, the detection passage 28 is closed on the suction side of the pump 14 and the pressure introducing passage 512 is brought into the atmosphere and hence the pressure difference detected by the differential pressure sensor 510 when the pump 14 is operated is substantially equal to the shutoff pressure of the pump 14.

According to the tenth embodiment, the pressure differences $\Delta P_{Air}$, $\Delta P_{Gas}$ and the shutoff pressure $\Delta P_t$ can be detected with more accuracy in the concentration measurement processing and hence the accuracy of computing the concentration "D" of fuel vapor can be improved.

In the tenth embodiment described above, the differential pressure sensor 510 corresponds to "differential pressure detecting means."

Eleventh Embodiment

Figure 31:
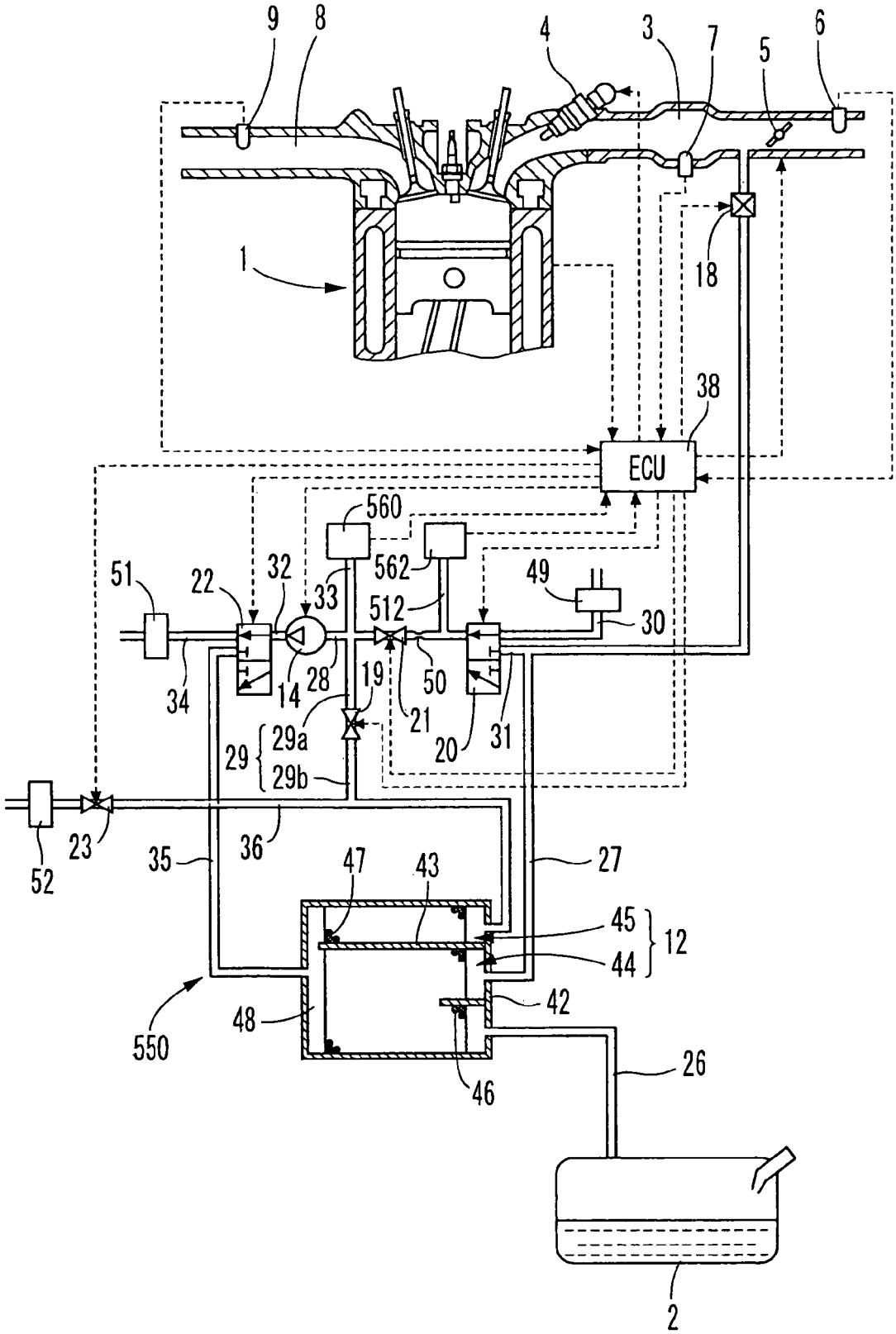
FIG. 31 is a construction diagram showing a fuel vapor processing apparatus according to an eleventh embodiment.

As shown in FIG. 31, an eleventh embodiment of the present invention is a modification of the tenth embodiment. The substantially same constituent parts as parts in the tenth embodiment will be denoted by the same reference symbols and their descriptions will be omitted.

In a fuel vapor processing apparatus 550 of the eleventh embodiment, in place of the differential pressure sensor 510, absolute pressure sensors 560, 562 electrically connected to the ECU 38 connect with the pressure introducing passages 33, 512, respectively. With this, the absolute pressure sensor 560 detects pressure receiving through the pressure introducing passage 33 from a portion closer to the pump 14 than the restrictor 50 of the detection passage 28 and the absolute pressure sensor 562 detects pressure receiving through the pressure introducing passage 512 from a portion closer to the passage changing valve 20 than the restrictor 50 of the detection passage 28. Hence, the difference between pressures detected by the respective absolute pressure sensors 560, 562 when the pump 14 is operated is substantially equal to the pressure difference between both ends of the restrictor 50 in a state where the passage opening/closing valve 21 is opened. Moreover, in a state where the passage opening/closing valve 21 is closed and where the passage changing valve 20 is in the first state, the detection passage 28 is closed with respect to the pump 14 and the pressure introducing passage 512 is brought to the atmospheric pressure and hence the difference between pressures detected by the absolute pressure sensors 560, 562 when the pump 14 is operated is substantially equal to the shutoff pressure of the pump 14.

According to the eleventh embodiment like this, in place of monitoring the pressure difference detected by the differential pressure sensor 16 in the steps S201 to S203 of the concentration measurement processing, the difference between pressures detected by the absolute pressure sensors 560, 562 is monitored. Hence, according to the eleventh embodiment, pressure differences $\Delta P_{Air}$, $\Delta P_{Gas}$ and shutoff pressure $\Delta P_t$ can be detected with more accuracy in the concentration measurement processing and hence the accuracy of computing the concentration "D" of fuel vapor can be improved.

In the eleventh embodiment described above, a set of absolute pressure sensors 560, 562 correspond to "differential pressure detecting means."

While the multiple embodiments of the present invention have been described above, it should be understood that it is not intended to limit the present invention to these embodiments.

Figure 32:
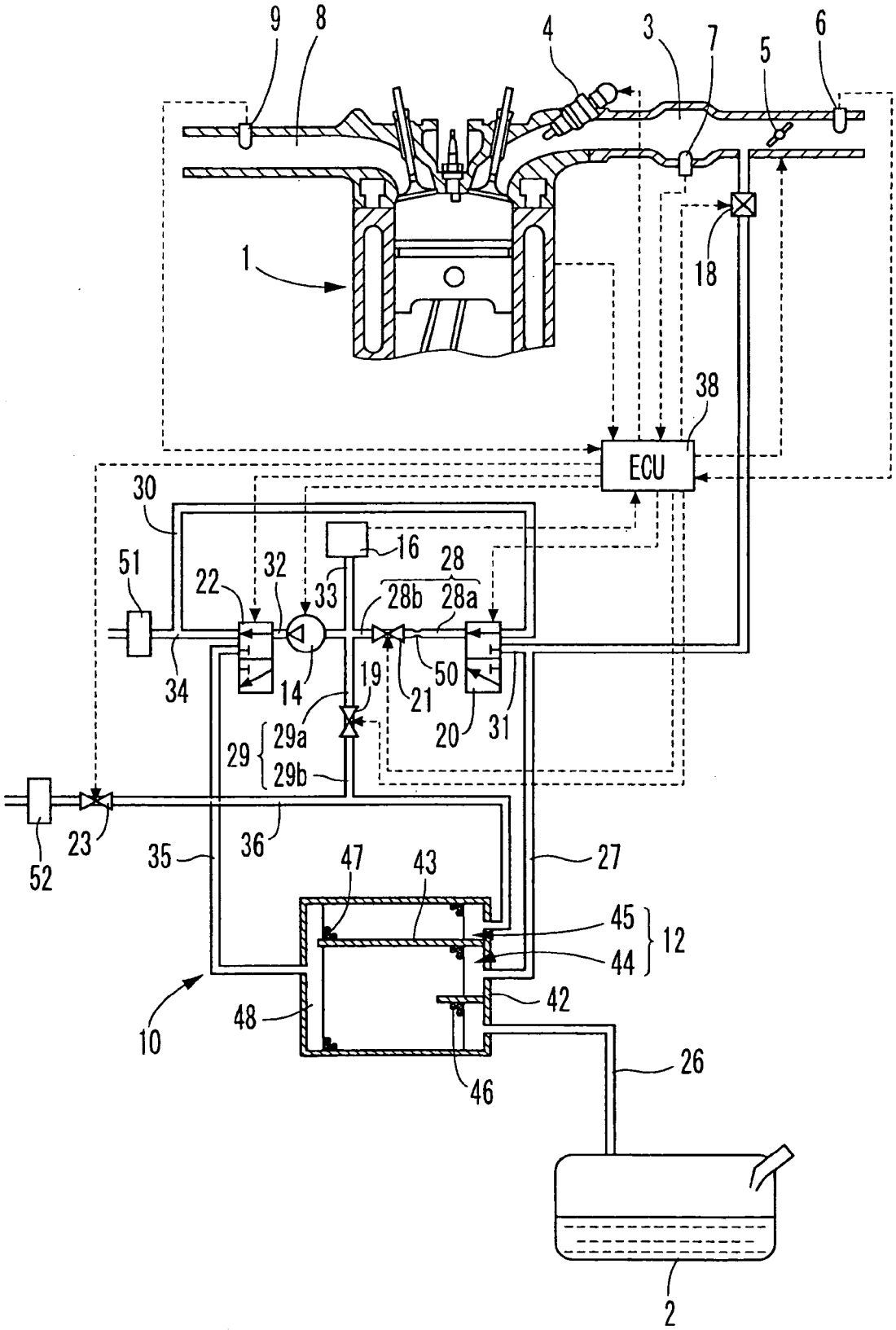
FIG. 32 is a construction diagram showing a fuel vapor processing apparatus according to a modification of the first embodiment.
Figure 33:
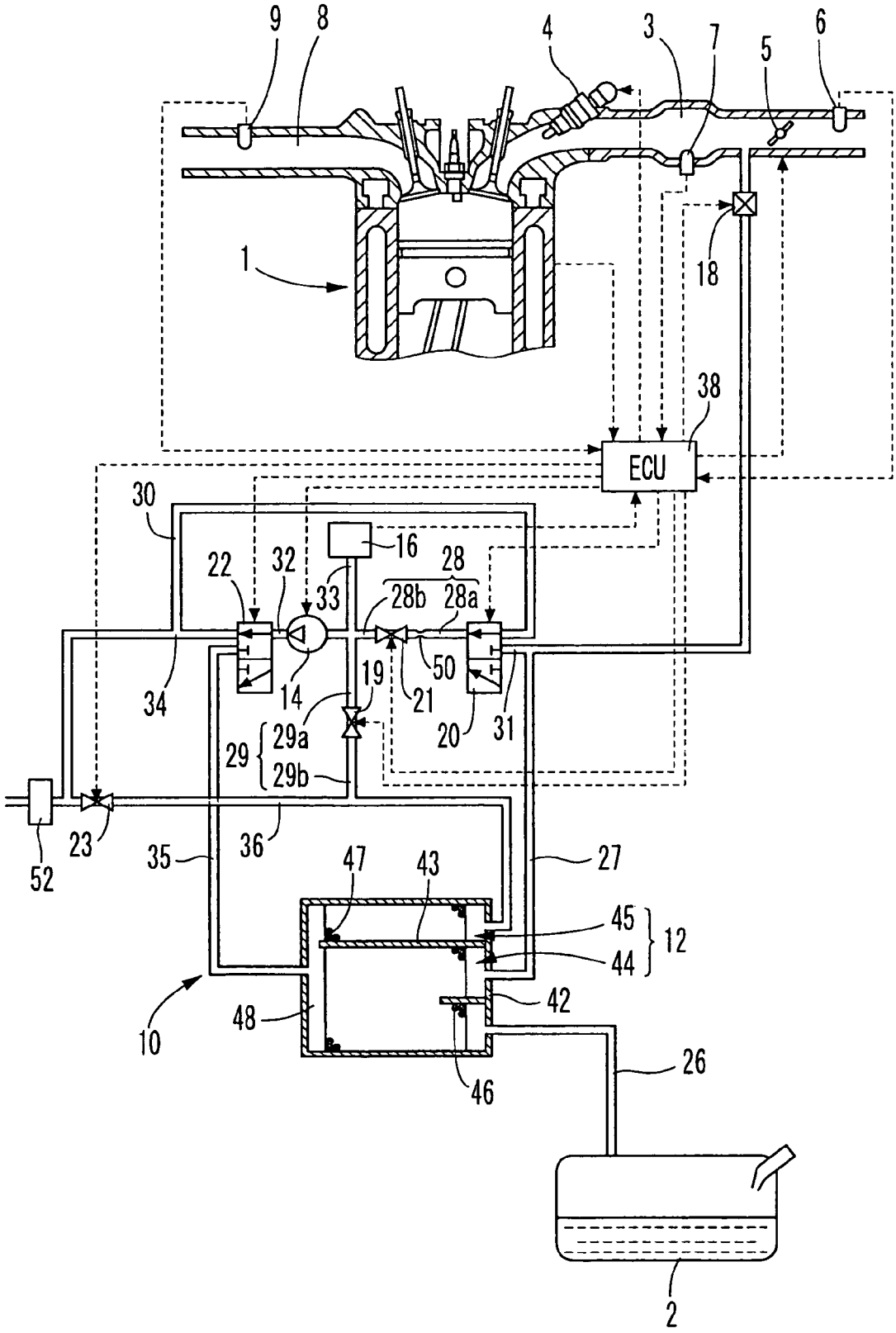
FIG. 33 is a construction diagram showing a fuel vapor processing apparatus according to a modification of the first embodiment.

For example, in the first to eleventh embodiments, it is also recommendable to decrease the number of filters by integrating the respective open ends of the first and second atmosphere passages 30, 34 into one, as shown in FIG. 32 (which shows a modification of the first embodiment). Alternatively, in the first to eleventh embodiments, in a case where the vapor adsorbing capacity of the canister 12 is sufficiently high, it is also recommendable to further decrease the number of filters by integrating the respective open ends of the first to third atmosphere passages 30, 34, 36 into one, as shown in FIG. 33 (which is a modification of the first embodiment).

Figure 34:
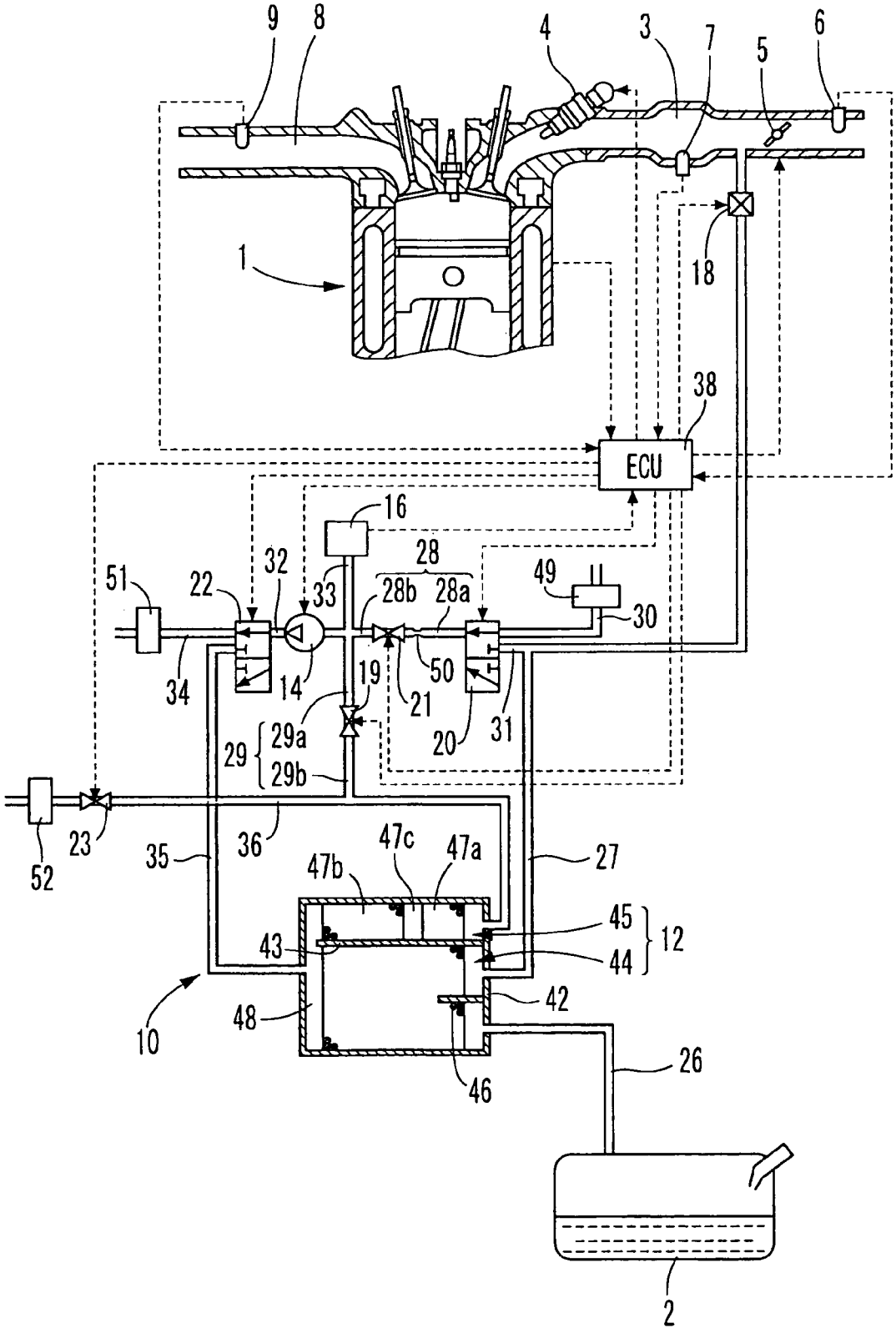
FIG. 34 is a construction diagram showing a fuel vapor processing apparatus according to a modification of the first embodiment.

Further, in the first to eleventh embodiments, it is also recommendable to divide the adsorptive agent 47 of the subordinate part 45 into multiple agents and to form a space 47*c* between the divided adsorptive agents 47*a*, 47*b*, as shown in FIG. 34 (which shows a modification of the first embodiment). In this case, it is possible to increase the time required for fuel vapor, which is contained by the air-fuel mixture flowing from the transit passage 29 (the second transit passage 414 in the eighth embodiment) into the subordinate adsorption part 45, to reach the main adsorption part 44. As a result, it is possible to more effectively prevent an actual purge concentration from being deviated from the computed value D in the concentration measurement processing.

Further, in the first to eleventh embodiments, it is also recommendable to carry out the concentration measurement processing by interchanging step S201 with step S202. Moreover, in the first to eleventh embodiments, it is also recommendable not to control the number of revolutions of the pump 14 in the steps S201 to 203 of the concentration measurement processing.

Still further, in the first to eleventh embodiments, in a case where the purging of air-fuel mixture from a portion closer to the passage changing valve 20 than the connection portion of the transit passage 29 of the detection passage 28 is completed in the first purge processing, it is also recommendable to continue purging the air-fuel mixture from a portion closer to the pump 14 than the connection portion of the transit passage 29 of the detection passage 28 in a state where the passage opening/closing valve 21 is closed. Moreover, in the first to eleventh embodiments, it is also recommendable to hold the connection controlling valve 19 opened in the second purge processing. With this, pressure loss at the time of the second purge processing can be decreased by the flow rate passing through the transit passage 29 and hence a more quantity of purge can be secured.

Figure 35:
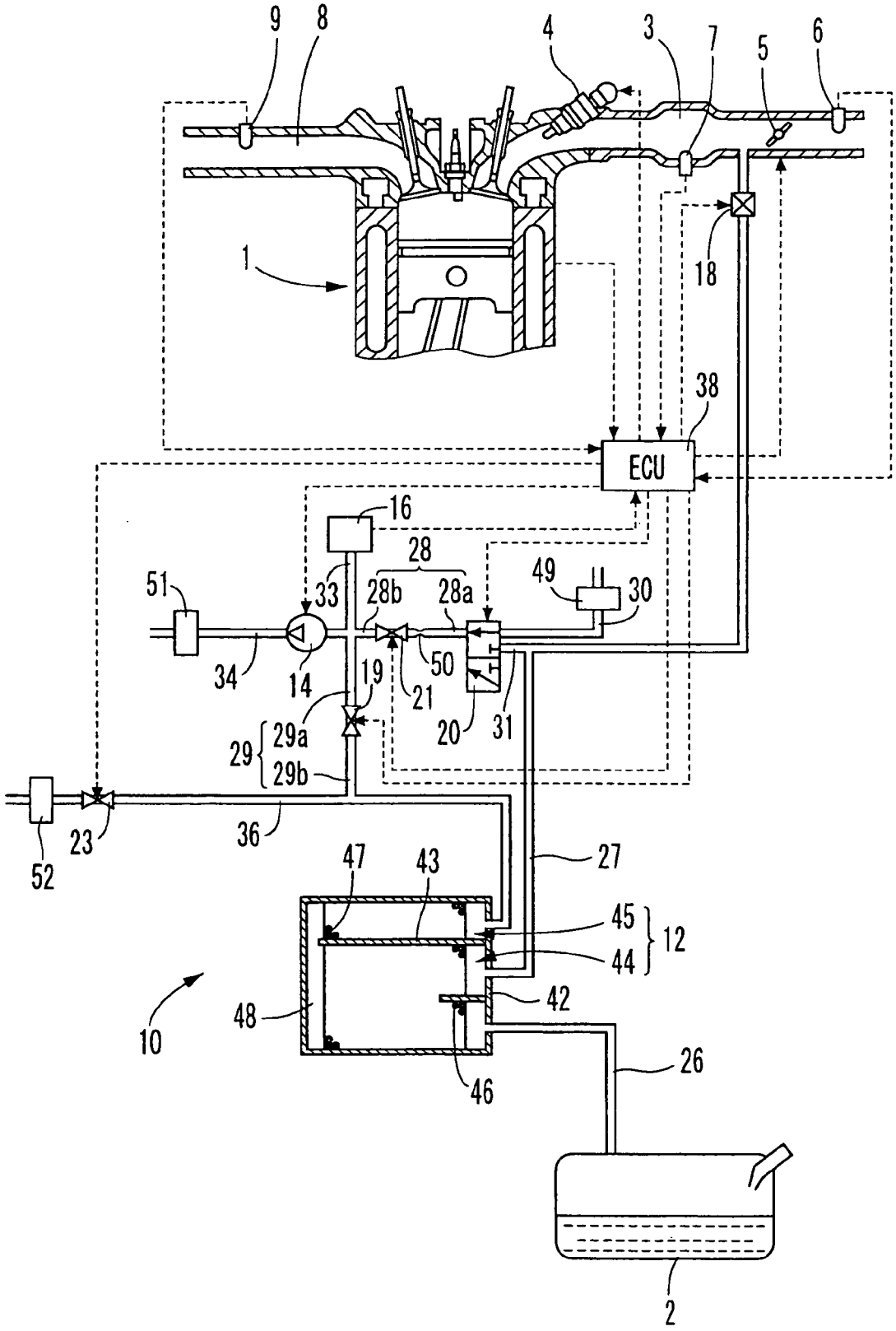
FIG. 35 is a construction diagram showing a fuel vapor processing apparatus according to a modification of the first embodiment.

Still further, in the first to eleventh embodiments, in the step S203 of the concentration measurement processing, the detecting of the pressure difference $\Delta P_{Gas}$ is finished by the time when the air-fuel mixture containing fuel vapor reaches the pump 14. Then, it is also recommended that the discharge changing valve 22 (discharge connecting valves 460, 462 in the ninth embodiment) for returning the discharge gas of the pump 14 to the canister 12 in step S203 is not provided but that the discharge port of the pump 14 is directly connected to the second atmosphere passage 34, as shown in FIG. 35 (which shows a modification of the first embodiment).

Figure 36:
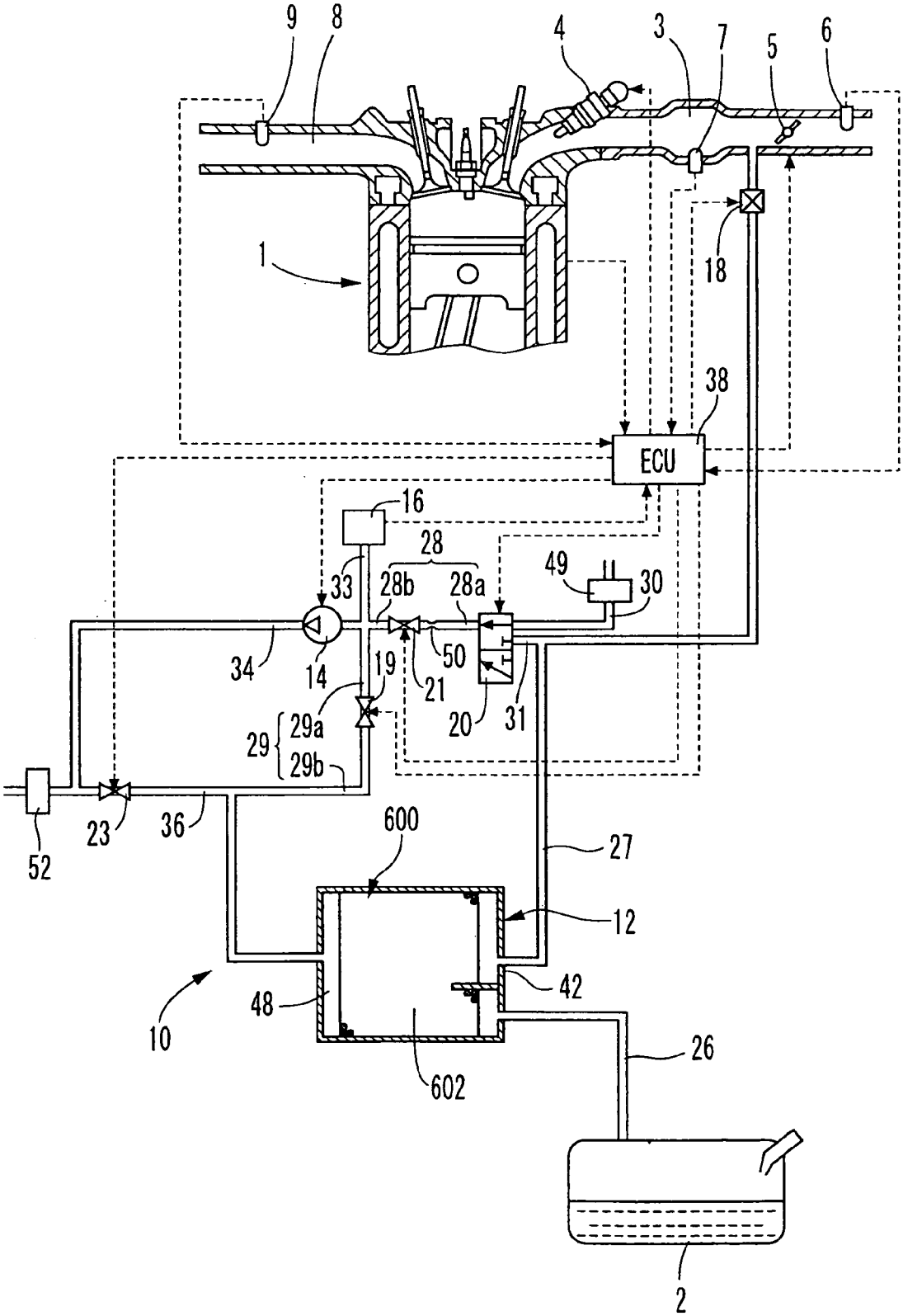
FIG. 36 is a construction diagram showing a fuel vapor processing apparatus according to a modification of the first embodiment.

In addition, in the first to eleventh embodiments, it is also recommendable to construct the canister 12 of one adsorption part 600 and to connect the transit passage 29 connecting with the third atmosphere passage 36 to the side opposite to the introduction passage 26 and the purge passage 27 across an adsorptive agent 602, as shown in FIG. 36 (which shows a modification of the first embodiment). In this case, for example, it is also recommended that the discharge changing valve 22 (discharge connecting valves 460, 462 in the ninth embodiment) is not provided but that the second atmosphere passage 34 directly connecting with the discharge port of the pump 14 is connected with the open end of the third atmosphere passage 36.

In more addition, in the third to fifth embodiments, it is also recommendable to construct expanded portions 162, 212, 262 having passage area expanded at a portion between the passage opening/closing valve 21 and connection portion of the transit passage 29 in the detection passages 160, 210, 260. Moreover, in a case where the specific gravity of fuel vapor generated in the fuel tank 2 relative to air is smaller than 1, in the fourth embodiment, it is desirable to arrange the portion 213 connecting with the pump 14 side of the expanded portion 212 below the portion 214 connecting with the passage opening/closing valve 21 (restrictor 50) side of the expanded portion 212. This is because the flowing speed of the air-fuel mixture in the expanded portion 212 is decreased by this construction. Similarly, in a case where the specific gravity of fuel vapor relative to air is smaller than 1, in the fifth embodiment, it is preferable to arrange the pump side end portion 265 of the meandering portion 264 below the meandering point 266 closest to the end portion 265. This is because the flowing speed of the air-fuel mixture in the expanded portion 262 is decreased by this construction.

In still more addition, in the sixth to eleventh embodiments, it is also recommendable to provide any one of the detection passages 110, 160, 210, 260 of the second to fifth embodiments in place of the detection passage 28. Moreover, in the seventh to eleventh embodiments, in accordance with the sixth embodiment, it is also recommendable to provide the passage connecting valves 310, 312 made of a two-way valve in place of the passage changing valve 20 made of a three-way valve.

In still more addition, in the ninth to eleventh embodiments, in accordance with the seventh embodiment, it is also recommendable to provide the second discharge passage 360 connecting with the third atmosphere passage 36 in place of the second discharge passage 35 connecting with the space 48 of the canister 12. Alternatively, in accordance with the eighth embodiment, it is also recommendable to provide the connection changing valve 410 made of a three-way valve in place of the connection controlling valve 19 and the canister closing valve 23 both of which are two-way valves. Moreover, in the tenth and eleventh embodiments, in accordance with the ninth embodiment, it is also recommendable to provide the discharge connecting valves 460, 462 made of two-way valves in place of the discharge changing valve 22 made of a three-way valve.

What is claimed is:

1. A fuel vapor processing apparatus comprising:

a canister for adsorbing fuel vapor generated in a fuel tank in such a way that the fuel vapor can be desorbed;

a purge passage for introducing an air-fuel mixture containing fuel vapor desorbed from the canister into an intake passage of an internal combustion engine and for purging the fuel vapor thereinto;

an atmosphere passage for connecting the canister with an atmosphere;

a gas flow producing means provided in the atmosphere passage for producing a gas flow;

a pressure detecting means for detecting a pressure in the atmosphere passage, and a fuel vapor concentration calculating means for calculating a fuel vapor concentration based on an output of the pressure detecting means when the gas flow producing means produces the gas flow, wherein the pressure detecting means detects the pressure during a detection period of time until the air-fuel mixture reaches the gas flow producing means.

2. The fuel vapor processing apparatus according to claim 1, wherein the atmosphere passage has a restrictor that is provided between the canister and the pressure detecting means.

3. A fuel vapor processing apparatus comprising:

a canister for adsorbing fuel vapor generated in a fuel tank in such a way that the fuel vapor can be desorbed;

a purge passage for introducing an air-fuel mixture containing fuel vapor desorbed from the canister into an intake passage of an internal combustion engine and for purging the fuel vapor thereinto;

an atmosphere passage open to atmosphere;

a detection passage having a restrictor;

a passage changing means for changing a passage connecting with the detection passage between the purge passage and the atmosphere passage;

a pump connecting with the detection passage on a side opposite to the passage changing means across the restrictor;

a pressure detecting means for detecting a pressure depending on the restrictor and the pump; and a concentration computing means for computing a concentration of fuel vapor in the air-fuel mixture on the basis of detection result of the pressure detecting means;

wherein when the passage changing means causes the purge passage to connect with the detection passage and the pump reduces pressure in the detection passage to pass the air-fuel mixture through the restrictor, the pressure detecting means detects the pressure during a detection period of time that elapses after the air-fuel mixture passes through the restrictor until the air-fuel mixture reaches the pump.

4. The fuel vapor processing apparatus according to claim 3, wherein the pump stops reducing the pressure in the detection passage after the detection period by the time when the air-fuel mixture reaches the pump.

5. The fuel vapor processing apparatus according to claim 3, further comprising:

a first transit passage connecting with the detection passage between the restrictor and the pump;

a second transit passage connecting with the canister; and a connection controlling means for controlling connection between the first transit passage and the second transit passage, wherein the connection controlling means interrupts the connection between the first transit passage and the second transit passage during the detection period, and wherein the connection controlling means causes the first transit passage to connect with the second transit passage after the detection period.

6. The fuel vapor processing apparatus according to claim 5, wherein the canister includes a first adsorption part connecting with the second transit passage and adsorbing fuel vapor in the air-fuel mixture flowing in from the second transit passage, and a second adsorption part connecting with the purge passage and adsorbing fuel vapor desorbed from the first adsorption part and fuel vapor generated in the fuel tank, and the first adsorption part and the second adsorption part are connected with each other via a space.

7. The fuel vapor processing apparatus according to claim 5, further comprising purge controlling means for controlling connection between the purge passage and the intake passage to control a purge of the fuel vapor, wherein in a purge period after the detection period, the connection controlling means causes the first transit passage to connect with the second transit passage, and the purge controlling means causes the purge passage to connect with the intake passage.

8. The fuel vapor processing apparatus according to claim 7, wherein after the purge period, the connection controlling means interrupts connection between the first transit passage and the second transit passage.

9. The fuel vapor processing apparatus according to claim 3, further comprising purge controlling means for controlling connection between the purge passage and the intake passage to control a purge of the fuel vapor, wherein the purge controlling means interrupts connection between the purge passage and the intake passage during the detection period.

10. The fuel vapor processing apparatus according to claim 3, wherein the detection passage has a volume part having a passage volume expanded between the restrictor and the pump.

11. The fuel vapor processing apparatus according to claim 3, wherein the fuel vapor of which specific gravity relative to air is larger than 1 is generated in the fuel tank, and the detection passage includes a first connection part connecting with the restrictor, a second connection part connecting with the pump and provided above the first connection part, and a third connection part for connecting the first connection part with the second connection part.

12. The fuel vapor processing apparatus according to claim 3, wherein the fuel vapor of which specific gravity relative to air is smaller than 1 is generated in the fuel tank, and the detection passage includes a first connection part connecting with the restrictor, a second connection part connecting with the pump and provided below the first connection part, and a third connection part for connecting the first connection part with the second connection part.

13. The fuel vapor processing apparatus according to claim 3, wherein the detection passage includes a meandering part meandering and extending between the restrictor and the pump.

14. The fuel vapor processing apparatus according to claim 13, wherein the fuel vapor of which specific gravity relative to air is larger than 1 is generated in the fuel tank, and a pump side end of the meandering part is provided above a meandering point closest to the end.

15. The fuel vapor processing apparatus according to claim 13, wherein the fuel vapor of which specific gravity relative to air is smaller than 1 is generated in the fuel tank, and a pump side end of the meandering part is provided below a meandering point closest to the end.

16. The fuel vapor processing apparatus according to claim 3, further comprising pump controlling means for controlling the number of revolutions of the pump to a constant value during the detection period.

17. The fuel vapor processing apparatus according to claim 3, further comprising:

a passage opening/closing means for opening/closing the detection passage at a portion closer to the pump than the purge passage and the atmosphere passage, wherein a first pressure detection period is set in which the pressure detecting means detects the pressure as a first pressure in a state where the passage opening/closing means opens the detection passage and where the passage changing means causes the atmosphere passage to connect with the detection passage and where the pump reduces pressure in the detection passage, a second pressure detection period is set in which the pressure detecting means detects the pressure as a second pressure in a state where the passage opening/closing means opens the detection passage and where the passage changing means causes the purge passage to connect with the detection passage and where the pump reduces pressure in the detection passage, a shutoff pressure detection period is set in which the pressure detecting means detects a shutoff pressure of the pump in a state where the passage opening/closing means closes the detection passage and where the pump reduces pressure in the detection passage, and the concentration computing means computes a concentration of fuel vapor in the air-fuel mixture from the first pressure, the second pressure difference, and the shutoff pressure.

18. The fuel vapor processing apparatus according to claim 17, wherein the shutoff pressure detection period is set successively after the first pressure detection period.

19. The fuel vapor processing apparatus according to claim 17, wherein the second pressure detection period is set after the first pressure detection period and the shutoff pressure detection period.

20. The fuel vapor processing apparatus according to claim 17, wherein the passage opening/closing means opens or closes the detection passage between the restrictor and the pump.

21. The fuel vapor processing apparatus according to claim 3, wherein the pressure depending on the restrictor and the pump is detected between the restrictor and the pump.

22. The fuel vapor processing apparatus according to claim 3, wherein the pressure detecting means is a relative pressure sensor which detects a relative pressure relative to an atmosphere.

23. The fuel vapor processing apparatus according to claim 3, wherein the pressure detecting means is an absolute pressure sensor detecting an absolute pressure.

24. The fuel vapor processing apparatus according to claim 3, wherein the pressure depending on the restrictor and the pump is a differential pressure between both ends of the restrictor.

25. The fuel vapor processing apparatus according to claim 3, wherein the pressure detecting means is a differential pressure detecting means for detecting a differential pressure between both ends of the restrictor.

* * * * *